US011746973B1

(12) United States Patent
Betz et al.

(10) Patent No.: US 11,746,973 B1
(45) Date of Patent: Sep. 5, 2023

(54) HANGING LIQUID LAMP

(71) Applicant: Barava, LLC, Moscow, ID (US)

(72) Inventors: Johnny Betz, Moscow, ID (US); Gavin Curtis, Moscow, ID (US)

(73) Assignee: Barava, LLC, Moscow, ID (US)

( * ) Notice: Subject to any disclaimer, the term of this patent is extended or adjusted under 35 U.S.C. 154(b) by 0 days.

(21) Appl. No.: 17/736,769

(22) Filed: May 4, 2022

(51) Int. Cl.

| | |
|---|---|
| ***F21S 10/00*** | (2006.01) |
| ***F21V 23/04*** | (2006.01) |
| ***H05B 47/19*** | (2020.01) |
| ***H05B 47/155*** | (2020.01) |
| ***H05B 1/02*** | (2006.01) |
| ***H05B 3/22*** | (2006.01) |
| ***H05B 47/165*** | (2020.01) |
| ***F21Y 115/10*** | (2016.01) |

(52) U.S. Cl.
CPC ..... *F21S 10/002* (2013.01); *F21V 23/0485* (2013.01); *H05B 1/0216* (2013.01); *H05B 3/22* (2013.01); *H05B 47/155* (2020.01); *H05B 47/165* (2020.01); *H05B 47/19* (2020.01); *F21Y 2115/10* (2016.08); *H05B 2203/013* (2013.01); *H05B 2203/021* (2013.01)

(58) Field of Classification Search
CPC ... F21V 23/0485; H05B 47/19; H05B 47/155; H05B 47/165; H05B 1/0216; H05B 3/22; F21S 10/002
See application file for complete search history.

(56) References Cited

U.S. PATENT DOCUMENTS

| | | | | |
|---|---|---|---|---|
| 3,387,396 | A | 6/1968 | Smith | |
| 3,570,156 | A | 3/1971 | Walker | |
| 7,478,914 | B2 | 1/2009 | Finkle | |
| 7,598,686 | B2 | 10/2009 | Lys et al. | |
| 7,717,581 | B2 | 5/2010 | Lin et al. | |
| 7,871,173 | B2 * | 1/2011 | Lin | F21S 10/002 40/406 |
| 8,021,008 | B2 | 9/2011 | Ramer | |
| 8,162,498 | B2 | 4/2012 | Ramer et al. | |
| 8,294,389 | B2 * | 10/2012 | Finkle | H05B 45/10 315/32 |
| 8,746,913 | B2 * | 6/2014 | Tsai | F21S 10/002 362/101 |
| 9,328,884 | B2 * | 5/2016 | Yang | F21S 10/002 |
| 9,447,936 | B1 * | 9/2016 | Ho | F21V 19/005 |
| 10,337,719 | B2 * | 7/2019 | Chien | B44C 5/00 |

(Continued)

FOREIGN PATENT DOCUMENTS

| | | |
|---|---|---|
| CN | 203784810 | 8/2014 |
| WO | WO 2013/136236 | 9/2013 |

*Primary Examiner* — Arman B Fallahkhair
(74) *Attorney, Agent, or Firm* — Hawley Troxell Ennis & Hawley LLP; Rivkah Young

(57) ABSTRACT

A hanging liquid lamp system is provided that enables a vessel containing two or more liquids to be suspended securely from a support structure while providing power to components of the liquid lamp. A heating element is coupled to a bottom portion of the vessel and a logic board is configured to monitor one or more temperature sensors at different locations on or near the liquid lamp to allow for dynamic adjustment of the heat output of the heating element. One or more lighting elements are also provided, which are also able to be dynamically adjusted. The logic board of the liquid lamp system also enables a variety of multimedia and/or Internet of Things (IoT) features.

13 Claims, 18 Drawing Sheets

(56) References Cited

U.S. PATENT DOCUMENTS

| | | | | |
|---|---|---|---|---|
| 2014/0268675 | A1 | 9/2014 | Ho | |
| 2015/0159853 | A1 | 6/2015 | Maxik et al. | |
| 2016/0186939 | A1* | 6/2016 | Ho | F21V 33/0028 362/101 |

* cited by examiner

200B

200C

1200A

1200B

1200C

1200D

1200E

HANGING LIQUID LAMP

BACKGROUND

Many types of lamps are currently utilized daily for a variety of purposes, such as lighting, decoration, and entertainment. Some types of lamps include a vessel filled with liquids, which is exposed to a heating element, causing the liquids to move within the vessel, often creating an interesting visual effect. While many people enjoy this type of lamp for decoration and entertainment, traditional liquid lamps have a number of deficiencies which make them ill-suited for use in many settings.

For example, while traditional liquid lamps provide an ornamental glow, they don't produce light such that the lamp can be used to adequately illuminate the surrounding space. Further, traditional liquid lamps require a large table-top base capable of housing a heating element, such as an incandescent bulb, which is the traditional type of heating element utilized by liquid lamps to heat the liquids within the vessel. These traditional units are bulky and cumbersome and not practical for use in many spaces where there is a lack of tabletop surfaces and/or where tabletop surfaces need to be kept open for other uses. Further, in settings such as bars and restaurants, placing a liquid lamp on a table typically makes viewing of the liquid lamp more difficult for many of the people present.

Additionally, the methods used by traditional liquid lamps for heating the liquids inside the vessel are inefficient and inconvenient to use, resulting in wasted energy and limited use. A traditional liquid lamp utilizing an incandescent bulb can take a full day to heat up enough for the desired visual effects to be noticed. Further, because there is typically no control on the heat generated, other than an on/off switch, traditional liquid lamps become excessively hot after being left on for a length of time, which causes the liquids within the lamp to stop moving. Once a traditional liquid lamp has heat soaked, it needs to be turned off and cooled down before it can be restarted and become functional again. Additionally, in many instances, due to energy restrictions, incandescent bulbs capable of providing enough heat for traditional liquid lamps are no longer readily available.

As noted above, traditional liquid lamps operate from a simple on/off switch, and as such, have no mechanisms to monitor and adjust for liquid temperature and ambient temperature in order to prevent overheating and ensure that there is enough movement of the liquids over extended periods of time. Further, because traditional liquid lamps operate from a simple on/off switch, they can only provide one option for color of the glow produced, they are not capable of being synchronized with other lights, and they cannot provide Internet of Things (IoT) features that may be desirable in many settings.

As one illustrative example, establishments such as restaurants, bars, night clubs, and concert venues often provide choreographed light shows for entertainment, which requires the ability to synchronize tens, hundreds, or even thousands of lights. Due to the limitations of traditional liquid lamps, they are currently not capable of being used for this purpose. Previous attempts to add electronics and logic elements to liquid lamps have been unsuccessful due to the reliance of traditional liquid lamps on providing heating via an incandescent bulb, which leads to overheating and damage being caused to any electronics and logic elements that may be present within the lamp.

What is needed therefore is a liquid lamp that is capable of being securely suspended from above, utilizes an alternative heating mechanism such that logic elements can be safely housed in a portion of the lamp to enable digital control, and is capable of providing users of the liquid lamp with access to a variety of multimedia and/or IoT features.

SUMMARY

The disclosed embodiments address the above technical problems by providing a liquid lamp that is capable of being securely suspended from above, utilizes a state of the art heating mechanism so that logic elements can be safely housed in a portion of the lamp to enable digital control, and is capable of providing users of the liquid lamp with access to a variety of multimedia and/or IoT features.

In one embodiment, a power cord and a power supply are connected to a power source, and the power cord is utilized, at least in part, to suspend a liquid lamp from a support structure. In one embodiment, the liquid lamp includes a liquid vessel component, and a collar clamp component. In one embodiment, the power cord passes through an opening in a top portion of the collar clamp, and the collar clamp is secured to a mouth portion of the liquid vessel, such that the liquid vessel is able to be securely suspended from the support structure by the power cord and/or one or more support wires. In one embodiment, an upper circuit board is positioned between the collar clamp and the mouth of the lamp vessel, and the upper circuit board is coupled to electrical wires of the power cord. In one embodiment, the upper circuit board contains one or more LED lights and/or other low voltage/low power light sources to provide light from the top of the liquid lamp, and one or more thermistors to measure temperature at the top of the lamp vessel.

In one embodiment, the vessel component of the liquid lamp contains two or more distinct types of liquids. In one embodiment, a wire loom extends from the upper circuit board down the length of the liquid vessel to a bezel component of the liquid lamp. In one embodiment, the bezel component houses a main logic board, one or more LEDs, a heating element, and one or more additional thermistors to measure temperature at the bottom of the lamp vessel and/or to measure ambient temperature. In one embodiment, the bezel is physically coupled to the bottom of the liquid vessel and the main logic board and the heating element are coupled to electrical wires of the wire loom, which not only enables power to reach the main logic board, but also allows for communication between the main logic board, the heating element, and the upper circuit board.

In one embodiment, components of the main logic board are utilized to collect temperature readings from the one or more thermistors and to dynamically adjust the heat output of the heating element, in order to control the flow of the liquids in the lamp vessel and avoid overheating. In one embodiment, the heating element is a thin film heating element. In one embodiment the logic board contains one or more lighting zones, which are capable of generating light in thousands of different colors, and are fully controllable by via wireless communication between one or more electronic devices and components of the logic board. In various embodiments, the main logic board contains components that enable a variety of multimedia and/or IoT features. For example, in one embodiment, the main logic board of the liquid lamp disclosed herein enables wireless communication between thousands of individual lamps, such that a large number of lamps can be synchronized to choreograph light and multimedia shows for events in establishments such as restaurants, bars, night clubs, and music venues.

Consequently, the embodiments disclosed herein provide technical solutions to the technical problems presented by current and traditional liquid lamp devices.

Figure 1:
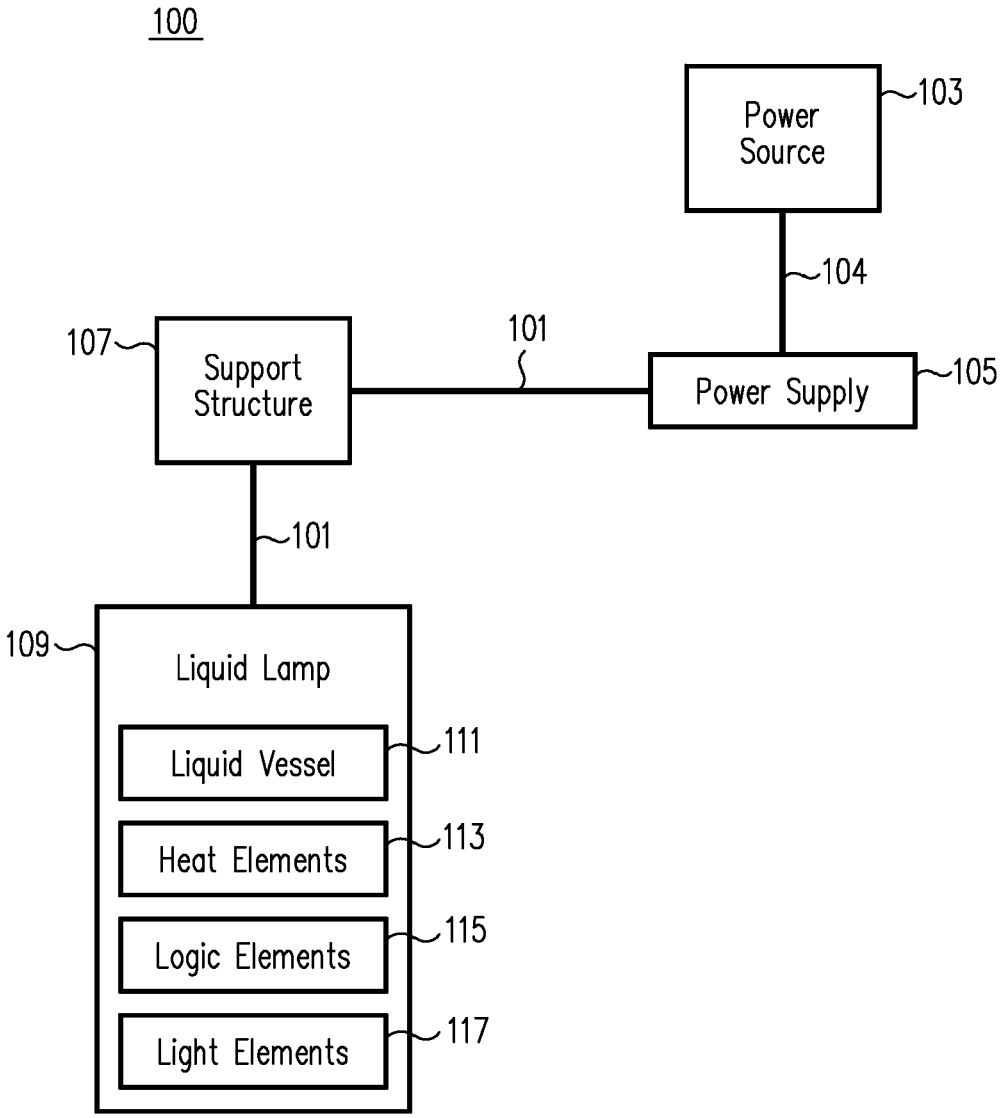
FIG. 1 is a block diagram of the main components of a hanging liquid lamp, in accordance with one embodiment.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION

Embodiments will now be discussed with reference to the accompanying figures, which depict one or more exemplary embodiments. Embodiments may be implemented in many different forms and should not be construed as limited to the embodiments set forth herein, shown in the figures, and/or described below. Rather, these exemplary embodiments are provided to allow a complete disclosure that conveys the principles of the invention, as set forth in the claims, to those of skill in the art.

As discussed above, the embodiments disclosed herein provide technical solutions to the technical problems presented by the current and traditional liquid lamp devices. For example, the disclosed embodiments provide for a hanging liquid lamp that utilizes a heating mechanism that is more convenient, efficient, reliable, and easier to control than traditional heating options for liquid lamps, such as incandescent bulbs. The heating mechanism disclosed herein allows logic elements to be safely housed in a portion of the liquid lamp such that users of the liquid lamp are able to digitally and dynamically control liquid temperature and flow of the liquids, as well as lighting and synchronization options. Further, users of the liquid lamp with are provided access to a variety of multimedia and/or IoT features.

FIG. 1 is a block diagram 100 of the main components of a hanging liquid lamp, in accordance with one embodiment.

In one embodiment, a hanging liquid lamp system includes main power cord 101, power source 103, power plug cord 104, power supply 105, support structure 107, liquid lamp 109, liquid vessel 111, heat elements 113, logic elements 115, and light elements 117, each of which will be discussed in detail below.

As shown in FIG. 1, in one embodiment, power source 103 is electrically coupled to power supply 105 by power plug cord 104. In various embodiments, power source 103 and power supply 105 are any type of power source and power supply as currently known and/or as developed after the time of filing, that are capable of generating enough power to safely power heat elements 113, logic elements 115, and light elements 117 of liquid lamp 109. In one embodiment, power supply 105 is coupled to main power cord 101, which allows power to reach the various elements of liquid lamp 109. In one embodiment, main power cord 101 is coupled to support structure 107 in such as way as to allow liquid lamp 109 to be securely suspended from support structure 107 by main power cord 101, as will be discussed in additional detail below. In one embodiment, liquid vessel 111 contains two or more liquids. In one embodiment, logic elements 115 are utilized to control heat elements 113 and light elements 117, as will be discussed in additional detail below.

Figure 2A:
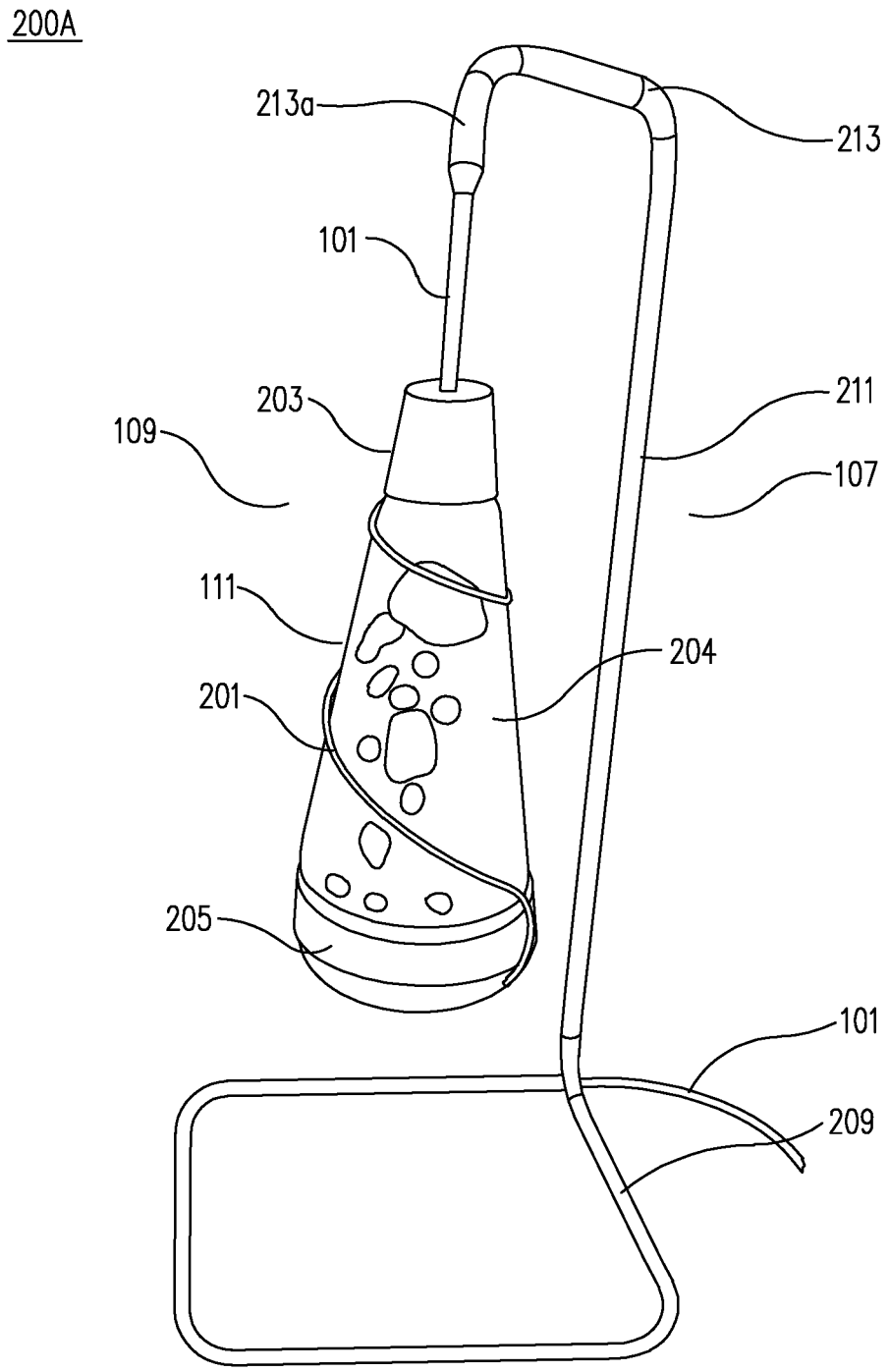
FIG. 2A is a view of a liquid lamp hanging from a support structure, in accordance with one embodiment.

FIG. 2A is a view 200A of liquid lamp 109 hanging from a support structure 107, in accordance with one embodiment.

In the embodiments disclosed herein, any type of support structure 107 can be utilized to hang liquid lamp 109, as long as it is capable of supporting the weight of a filled liquid lamp 109 in a suspended position while allowing power to reach the electronic components utilized by liquid lamp 109 through main power cord 101. One example of a support structure 107 is shown in FIG. 2A. In this particular embodiment, support structure 107 is designed to allow liquid lamp 109 to hang suspended over a flat surface, such as a table. The design shown in FIG. 2A allows for increased mobility of the liquid lamp, maximum placement options, and minimal surface space to be used, while also allowing light to be projected onto a surface below liquid lamp 109.

In the illustrative embodiment of FIG. 2A, support structure 107 includes support structure base 209, support structure post 211, support structure arm 213, and support structure arm distal end 213*a*, wherein liquid lamp 109 is hung from support structure arm distal end 213*a*. In the embodiment shown in FIG. 2A, main power cord 101 is inserted into tubing that makes up the body of support structure 107 at support structure base 209. Main power cord 101 then is then passed through support structure base 209, support structure post 211, and support structure arm 213, such that main power cord 101 emerges from support structure 107 at support structure arm distal end 213*a*. In one embodiment, this allows main power cord 101 to be coupled to a top portion of liquid lamp 109, such that liquid lamp 109 can be suspended from support structure 107 by main power cord 101.

In other embodiments, support structure 107 may include a horizontally situated pipe, rod, or beam from which one or more hanging liquid lamps 109 can be suspended. In one embodiment support structure 107 may be installed in the ceiling of a building or room, such that one or more liquid lamps 109 can be suspended from portions of a ceiling. In other embodiments, support structure 107 may include a structure mounted to a portion of a wall, wherein the structure includes a protrusion that protrudes outward from the wall, from which liquid lamp 109 may be suspended.

Also shown in FIG. 2A is one embodiment of a liquid vessel, liquid vessel 111, which is used to hold liquids for liquid lamp 109. Although a particular shape of liquid vessel 111 is shown in FIG. 2A, it should be noted that liquid vessel 111 can be any shape desired, as long as it is capable of being securely suspended from support structure 107. Additional details of liquid vessel 111 will be discussed further below.

Also shown in FIG. 2A are liquids 204 inside liquid vessel 111. In various embodiments, two or more liquids and/or liquid mixtures are utilized to create the desired visual effects, where one liquid (master liquid) has a different density/specific gravity than the other liquid (the ooze). As is known by those of skill in the art, the desired visual effects are made possible because liquids of different density/specific gravities behave differently in response to heat and other stimuli. Consequently, by controlling the heat output of a heating element associated with liquid lamp 109, the liquids can be made to flow in a variety of different ways. Examples of liquids that may be utilized by liquid lamp 109 as the master liquid include, but are not limited to, distilled water and distilled water mixed with polypropylene glycol. One example of a liquid that may be utilized by liquid lamp 109 as the ooze includes, but is not limited to, a mixture of paraffin wax and kerosene (also referred to as lamp oil). In various embodiments, other types of liquids may be utilized, provided that at least two of the liquids or liquid mixtures have different density/specific gravities. In some embodiments, dye may be added to the master liquid or the ooze to change the color of the liquids. Also shown in FIG. 2A are main wire loom 201, finish cap 203, and bezel 205, which will be discussed in additional detail below.

Figure 2B:
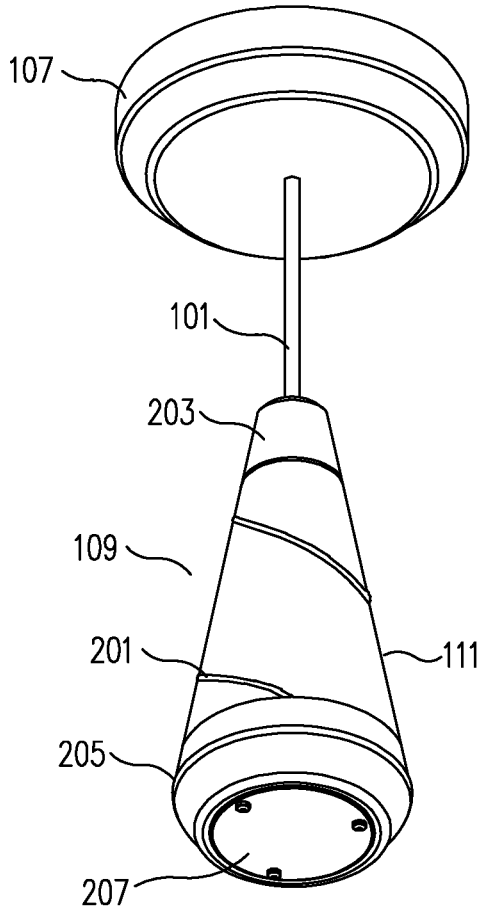
FIG. 2B and FIG. 2C are views of a liquid lamp hanging from a ceiling mount, in accordance with one embodiment.
Figure 2C:
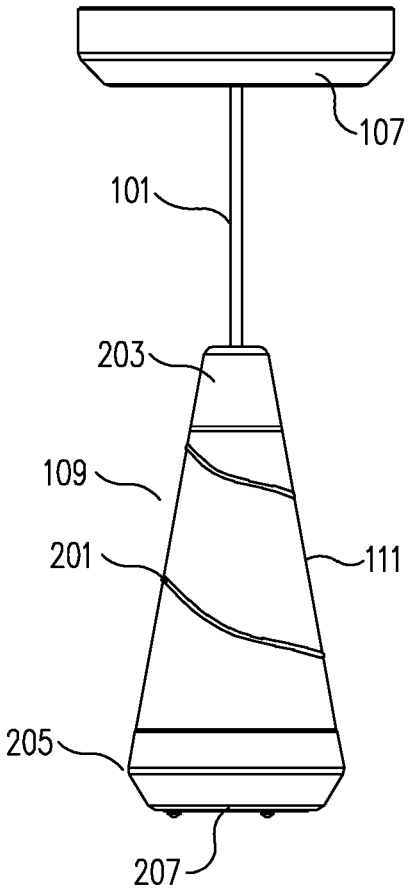

FIG. 2B and FIG. 2C are views 200B and 200C of liquid lamp 109 hanging from a ceiling mount, in accordance with one embodiment.

As noted above, in one embodiment, support structure 107 may be installed in the ceiling of a building or room, such that one or more liquid lamps 109 can be suspended from portions a ceiling. As shown in FIG. 2B and FIG. 2C, in one embodiment, support structure 107 is a ceiling mount, and power is provided to liquid lamp 109 from a power source 103 (not shown), through main power cord 101, which is also used to suspend liquid lamp 109 from support structure 107. Also shown in FIG. 2B and FIG. 2C is liquid vessel 111, main wire loom 201, finish cap 203, bezel 205, and lens 207, which will be discussed in detail below.

Figure 3A:
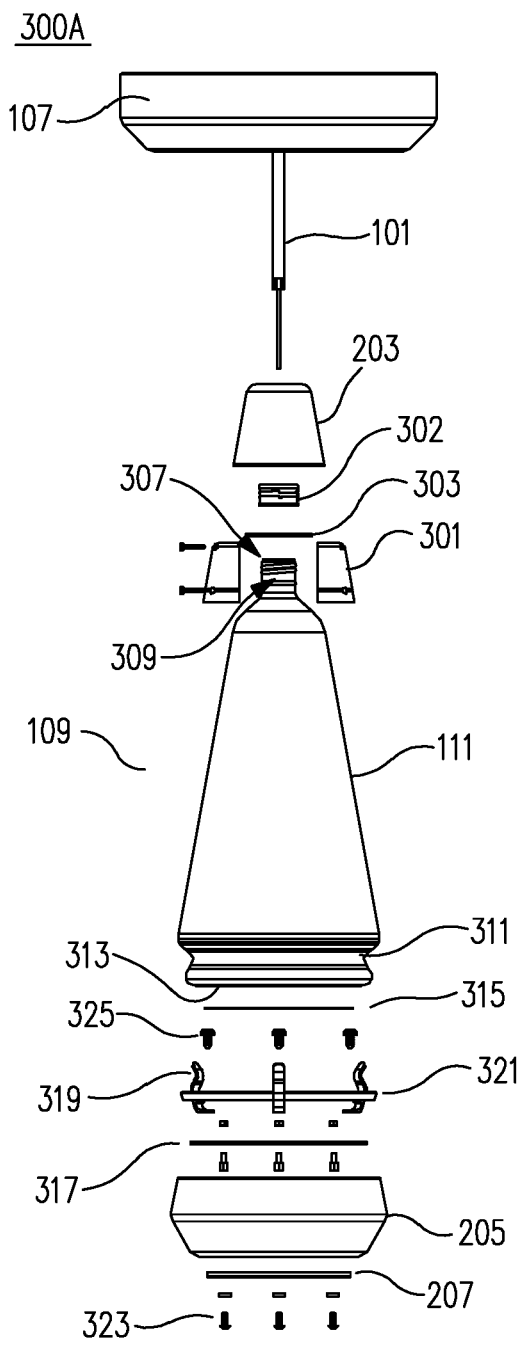
FIG. 3A and FIG. 3B are exploded views of the components of a liquid lamp, in accordance with one embodiment.
Figure 3B:
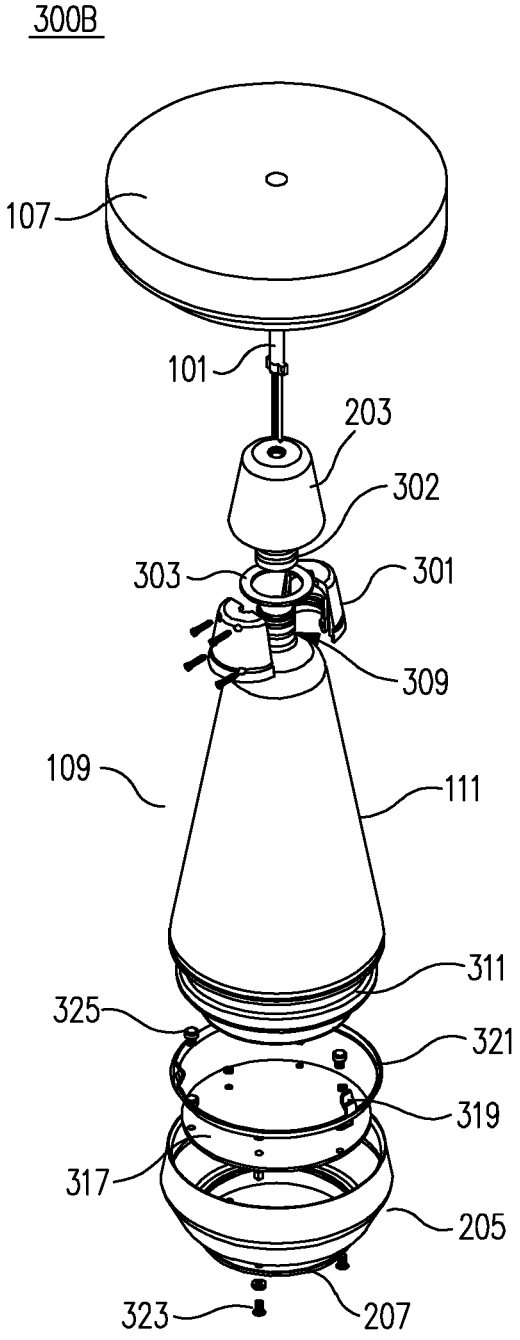

FIG. 3A and FIG. 3B are exploded views 300A and 300B of the components of liquid lamp 109, in accordance with one embodiment.

As noted above, the embodiments shown throughout the figures are but one illustrative example of a hanging liquid lamp. As will be clear to one of ordinary skill in the art, embodiments of the disclosed invention may be implemented in many different forms and should not be construed as limited to the embodiments as set forth herein, as shown in the figures, and/or as described below. Rather, these exemplary embodiments are provided to allow a complete disclosure that conveys the principles of the invention, as set forth in the claims, to those of skill in the art.

In the illustrative embodiment shown in FIG. 3A and FIG. 3B, liquid lamp 109 includes main power cord 101, finish cap 203, vessel cap 302, collar clamp 301, upper ring board 303, and liquid vessel 111. In one embodiment, liquid vessel 111 includes vessel mouth 307, transfer bead 309, and vessel clip notch 311. In one embodiment, liquid lamp 109 further includes thin film heater 313, heat insulator 315, main logic board 317, bezel clip prongs 319, bezel ring clip assembly 321, lens coupling components 323, ring clip coupling components 325, bezel 205, and lens 207, each of which will be discussed in additional detail below.

In the embodiment shown in FIG. 3A and FIG. 3B, two or more liquids (not shown) are transferred into liquid vessel 111, and vessel cap 302 is secured over vessel mouth 307. In one embodiment upper ring board 303 is positioned such that vessel mouth 307 passes through an opening in the center of upper ring board 303. In one embodiment, main power cord 101 hangs downward from support structure 107, and is passed through an opening in finish cap 203. In one embodiment, collar clamp 301 is provided in two halves with an opening at a top portion of collar clamp 301, which allows main power cord 101 to pass through collar clamp 301. In one embodiment, the two halves of collar clamp 301 are secured together around upper ring board 303, main power cord 101, and transfer bead 309. As will be shown in additional detail below, in one embodiment, main power cord 101 is held within collar clamp 301 by a crimp fitted onto main power cord 101, wherein the cord and crimp combination (not shown) is situated inside collar clamp 301, just below the top opening of collar clamp 301. In one embodiment, the cord and crimp combination prevents main power cord 101 from sliding out of collar clamp 301, and ensures that main power cord 101 is able to securely suspend liquid lamp 109 from support structure 107. In one embodiment, upper ring board 303 is electrically coupled to main power cord 101 within a cavity of collar clamp 301. Each of the above components will be discussed in additional detail in relation to FIG. 4A through FIG. 4E, FIG. 5A to FIG. 5E, FIG. 6A through FIG. 6D, FIG. 7, FIG. 8, and FIG. 13, which will be presented below.

In further reference to FIG. 3A and FIG. 3B, in one embodiment, bezel 205 serves as housing for one or more of thin film heater 313, heat insulator 315, and main logic board 317. In one embodiment, bezel 205 is able to be coupled securely to vessel clip notch 311 of a lower portion of liquid vessel 111 by means of bezel ring clip assembly 321, bezel clip prongs 319, and ring clip coupling components 325, which secure bezel ring clip assembly 321 into a cavity of bezel 205. In one embodiment, main logic board 317 is electrically coupled to upper ring board 303 by a wire loom (not shown), which will be discussed below. In one embodiment, bezel 205 has a downward facing opening which allows for coupling of lens 207 within the opening via lens coupling components 323. Each of the above elements will be discussed in additional detail in relation to FIG. 8, FIG. 9A, FIG. 9B, FIG. 10A through FIG. 10F, FIG. 11A, FIG. 11B, FIG. 12A through FIG. 12E, FIG. 14A, and FIG. 14B, which will be presented below.

FIG. 4A through FIG. 4E are views of a finish cap component of a liquid lamp, in accordance with one embodiment.

Figure 4A:
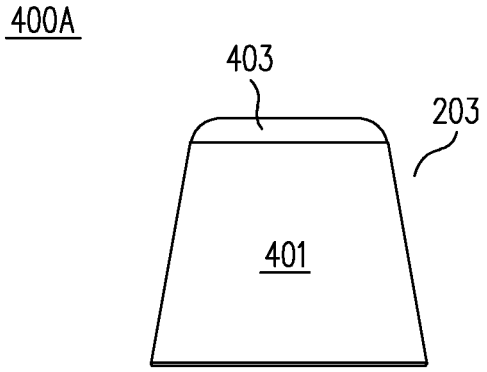
FIG. 4A through FIG. 4E are views of a finish cap component of a liquid lamp, in accordance with one embodiment.

More particularly, FIG. 4A is a front view 400A of finish cap 203 of a liquid lamp, in accordance with one embodiment.

Figure 4B:
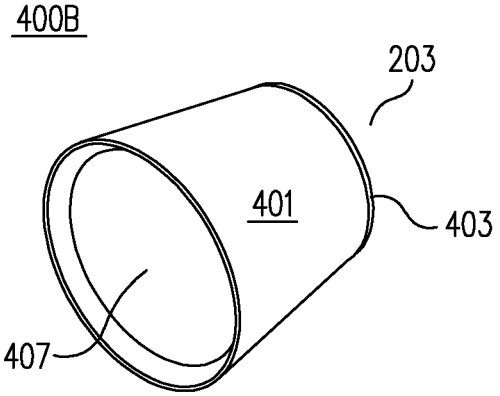

FIG. 4B is a perspective view 400B of a lower portion of finish cap 203 of a liquid lamp, in accordance with one embodiment.

Figure 4C:
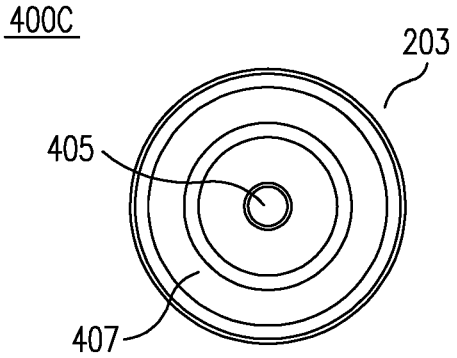

FIG. 4C is a bottom view 400C of finish cap 203 of a liquid lamp, in accordance with one embodiment.

Figure 4D:
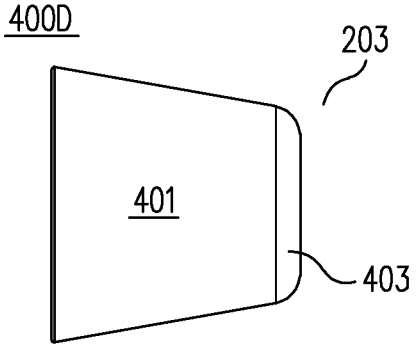

FIG. 4D is a side view 400D of finish cap 203 of a liquid lamp, in accordance with one embodiment.

Figure 4E:
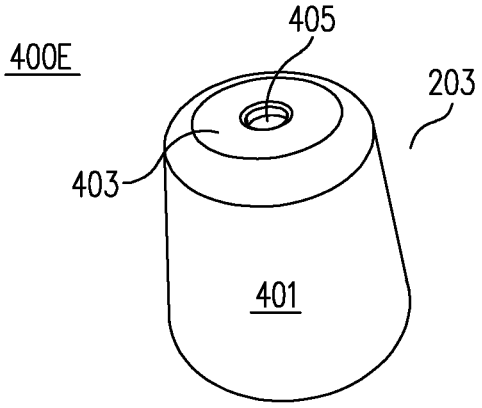

FIG. 4E is a perspective view 400E of an upper portion of finish cap 203 of a liquid lamp, in accordance with one embodiment.

As shown in FIG. 4A through FIG. 4E, in one embodiment, finish cap 203 includes finish cap outer wall 401, finish cap upper surface 403, finish cap upper opening 405, and finish cap interior cavity 407, which will be discussed in additional detail below.

Referring to FIG. 3A, FIG. 3B and FIG. 4A through FIG. 4E together, in one embodiment, main power cord 101 passes through finish cap upper opening 405 which in one embodiment is located in the center of finish cap upper surface 403. In one embodiment, finish cap 203 includes finish cap interior cavity 407, which is large enough to house collar clamp 301 once collar clamp 301 has been secured to transfer bead 309, as will be discussed in additional detail below. In one embodiment, after collar clamp 301 has been secured to transfer bead 309, finish cap 203 is loosely placed over collar clamp 301, such that collar clamp 301 rests completely within finish cap interior cavity 407. In one embodiment, finish cap 203 is not placed loosely over collar clamp 301, but is instead secured to or around collar clamp 301. In one embodiment finish cap 203 is not necessary or present as part of liquid lamp 109.

In one embodiment, finish cap outer wall 401 surrounds collar clamp 301 and related components to protect the components from dust and other external elements. In some embodiments finish cap 203 is ornamental and is used to hide the components underneath finish cap 203 from view. In other embodiments, finish cap 203 functions as a touch sensor which connects to upper ring board 303 and/or main logic board 317, which allows finish cap 203 to be used to control various features of liquid lamp 109. In some embodiments, main logic board 317 allows finish cap 203 to provide haptic feedback to a user when the touch sensing ability of finish cap 203 is activated. In some embodiments, the haptic feedback provided through finish cap 203 is utilized to inform users that commands being provided by the user are acknowledged. Additional details regarding the features of main logic board 317 will be discussed further below.

FIG. 5A through 5E are views of a collar clamp component of a liquid lamp, in accordance with one embodiment.

Figure 5A:
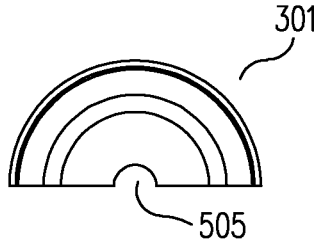
FIG. 5A through 5E are views of a collar clamp component of a liquid lamp, in accordance with one embodiment.

More particularly, FIG. 5A is a bottom view 500A of a first half of collar clamp 301 of a liquid lamp, in accordance with one embodiment.

Figure 5B:
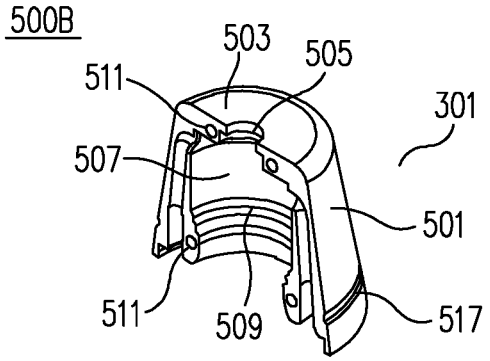

FIG. 5B is a perspective view 500B of a first half of collar clamp 301 of a liquid lamp, in accordance with one embodiment.

Figure 5C:
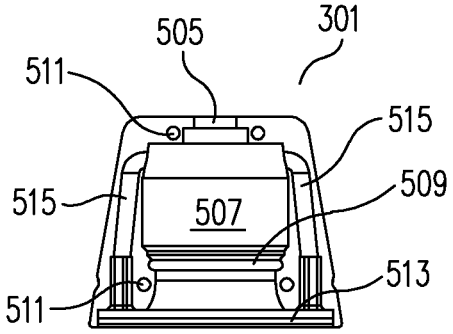

FIG. 5C is an interior view 500C of a first half of collar clamp 301 of a liquid lamp, in accordance with one embodiment.

Figure 5D:
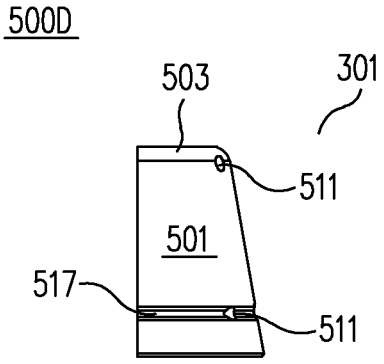

FIG. 5D is a side view 500D of a first half of collar clamp 301 of a liquid lamp, in accordance with one embodiment.

Figure 5E:
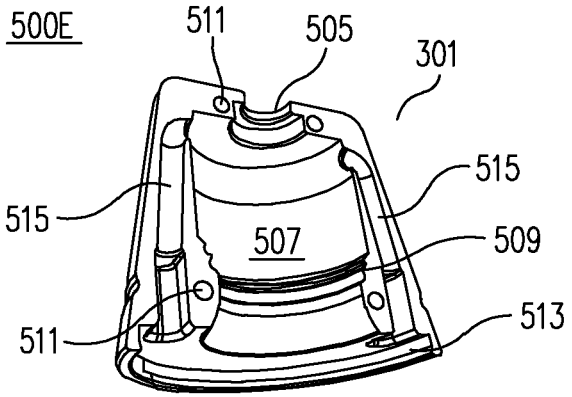

FIG. 5E is a perspective view 500E of a first half of collar clamp 301 of a liquid lamp, in accordance with one embodiment.

As shown in FIG. 5A through FIG. 5E, in one embodiment, collar clamp 301 includes collar clamp outer wall 501, collar clamp upper surface 503, color clamp upper opening 505, collar clamp interior cavity 507, collar clamp transfer bead grooves 509, collar clamp coupling holes 511, collar clamp ring board groove 513, collar clamp channels 515, and collar clamp finish cap groove 517, each of which will be discussed in additional detail below.

Referring to FIG. 3A, FIG. 3B, and FIG. 5A through FIG. 5E together, in one embodiment, once main power cord 101 has been passed through finish cap 203 (assuming an embodiment with finish cap 203 present), it is then passed through collar clamp upper opening 505 of collar clamp upper surface 503, and a crimp is placed around main power cord 101 so that the cord and crimp combination rests just below collar clamp upper opening 505, inside of collar clamp cavity 507.

FIG. 6A through FIG. 6D are views of a cord and crimp combination 601 of a liquid lamp, in accordance with one embodiment.

Figure 6A:
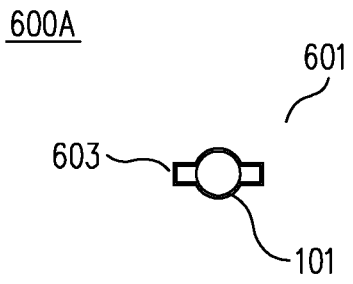
FIG. 6A through FIG. 6D are views of a cord and crimp combination of a liquid lamp, in accordance with one embodiment.

More particularly, FIG. 6A is an end view 600A of cord and crimp combination 601 of a liquid lamp, in accordance with one embodiment.

Figure 6B:
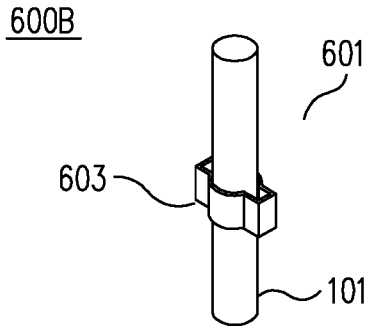

FIG. 6B is a perspective view 600B of cord and crimp combination 601 of a liquid lamp, in accordance with one embodiment.

Figure 6C:
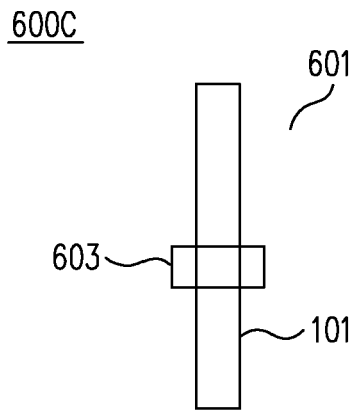

FIG. 6C is a front view 600C of cord and crimp combination 601 of a liquid lamp, in accordance with one embodiment.

Figure 6D:
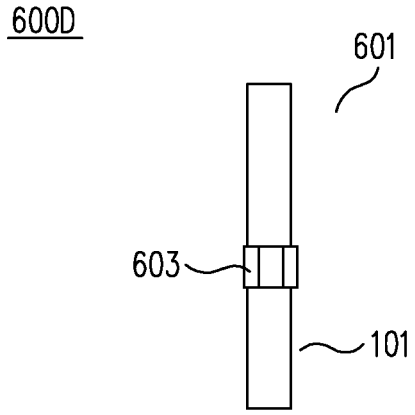

FIG. 6D is a side view 600D of cord and crimp combination 601 of a liquid lamp, in accordance with one embodiment.

Referring now to FIG. 5A through FIG. 5E and FIG. 6A through FIG. 6D together, in one embodiment, the ends of crimp 603 of cord and crimp combination 601 are crimped around main power cord 101, such that when cord and crimp combination 601 is placed below collar clamp upper opening 505, inside of collar clamp cavity 507, and the two halves of collar clamp 301 are coupled together, main power cord 101 is no longer able to freely slide through collar clamp upper opening 505. In one embodiment, the unique configuration of collar clamp 301 ensures that the liquid lamp can be safely and securely suspended by main power cord 101 from a support structure, as discussed above.

Figure 7:
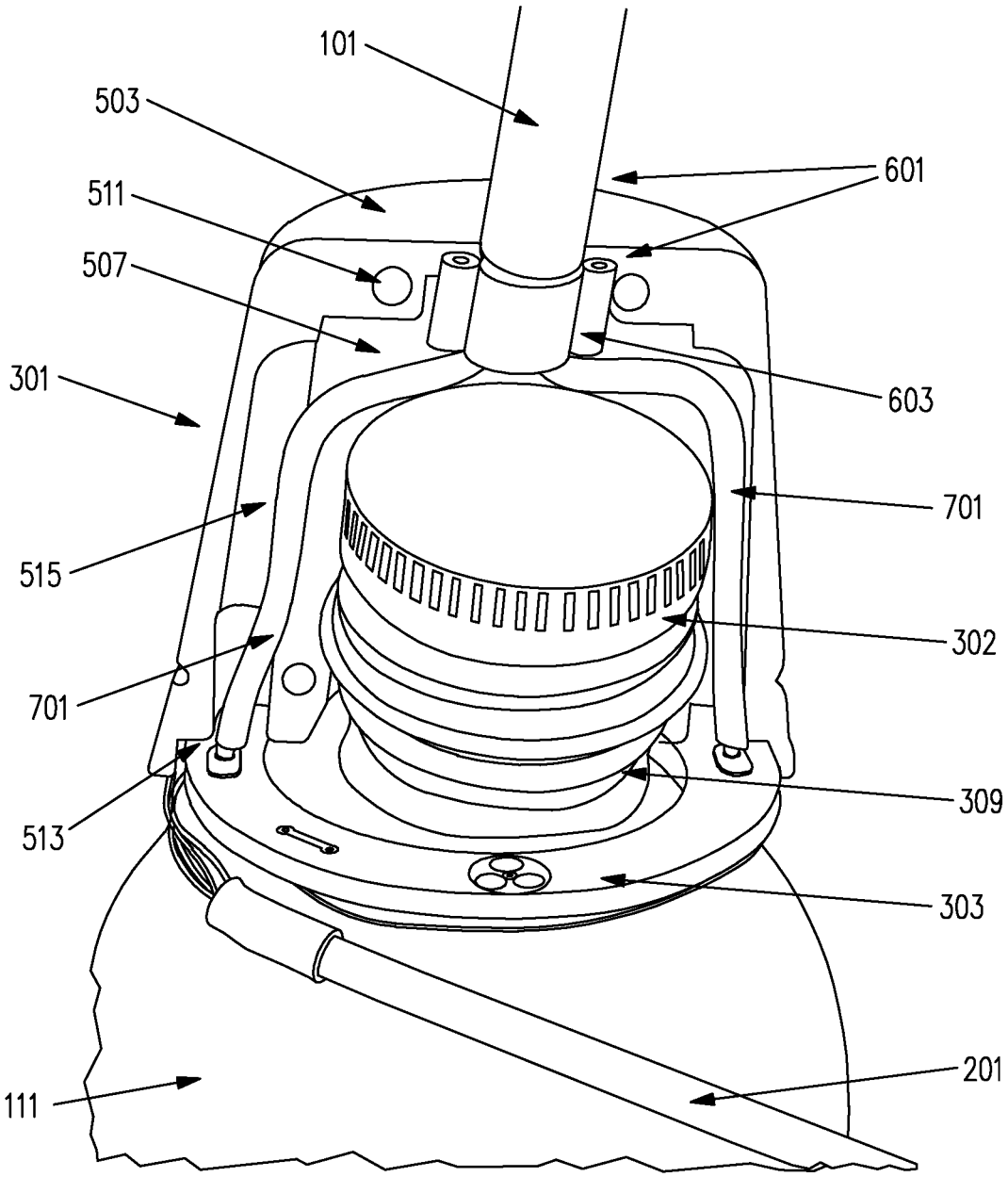
FIG. 7 is a view 700 of a collar clamp being secured to a liquid lamp, in accordance with one embodiment.

FIG. 7 is a view 700 of a collar clamp 301 being secured to a hanging liquid lamp, in accordance with one embodiment. Additionally, FIG. 3A and FIG. 3B discussed above provide an alternate view of collar clamp 301 being secured to a hanging liquid lamp, in accordance with one embodiment.

Referring now to FIG. 3A, FIG. 3B, FIG. 5A through FIG. 5E and FIG. 7 together, in one embodiment, cord and crimp combination 601 comprising main power cord 101 and crimp 603 is positioned within a first half of collar clamp 301. Specifically, cord and crimp combination 601 is placed into collar clamp upper opening 505 of the first half of collar clamp 301 such that crimp 603 rests just below collar clamp upper opening 505, inside of collar clamp cavity 507. Power wires 701 of main power cord 101 are then placed within collar clamp channels 515 of collar clamp 301, as shown in view 700 of FIG. 7. In one embodiment, placing power wires 701 within collar clamp channels 515 ensures that power wires 701 will not obstruct collar clamp transfer bead grooves 509.

In one embodiment, upper ring board 303 is placed over the vessel mouth 307 of liquid vessel 111, which in view 700, is covered by vessel cap 302. In one embodiment, upper ring board 303 is positioned such that one or more LEDs (not shown) on upper ring board 303 face downwards, toward the body of liquid vessel 111, as will be discussed in additional detail below. In one embodiment, the first half of collar clamp 301 is placed around a first half of vessel mouth 307, such that the first half of vessel mouth 307 is positioned within collar clamp cavity 507 of the first half of collar clamp 301, and a first half of transfer bead 309 is positioned within collar clamp transfer bead grooves 509 of the first half of collar clamp 301. In one embodiment, the first half of collar clamp 301 is also positioned such that a first half of upper ring board 303 is positioned within collar clamp ring board groove 513 of the first half of collar clamp 301. In one embodiment, power wires 701 are electrically coupled to upper ring board 303.

In one embodiment, once the first half of collar clamp 301 is in place, a second half of collar clamp 301 (shown in FIG. 3A and FIG. 3B), which is identical (or nearly identical) to the first half of collar clamp 301 is then placed around the second half of vessel mouth 307. In one embodiment, the second half of upper ring board 303 fits within collar clamp ring board groove 513 of the second half of collar clamp 301, the second half of transfer bead 309 fits within collar clamp transfer bead grooves 509 of the second half of collar clamp 301, and vessel mouth 307 is fully enclosed within collar clamp cavity 507 of the first and second halves of collar clamp 301. Collar clamp coupling holes 511 of the first and second halves of collar clamp 301 are then utilized along with a fastening mechanism, such as but not limited to, screws or pins, to fully secure collar clamp 301 around transfer bead 309. In one embodiment, this configuration allows main wire loom 201 to be extended from upper ring board 303 down the body of liquid vessel 111 for use in providing power and communicating with other parts of liquid lamp 109, as will be discussed in additional detail below.

Figure 8:
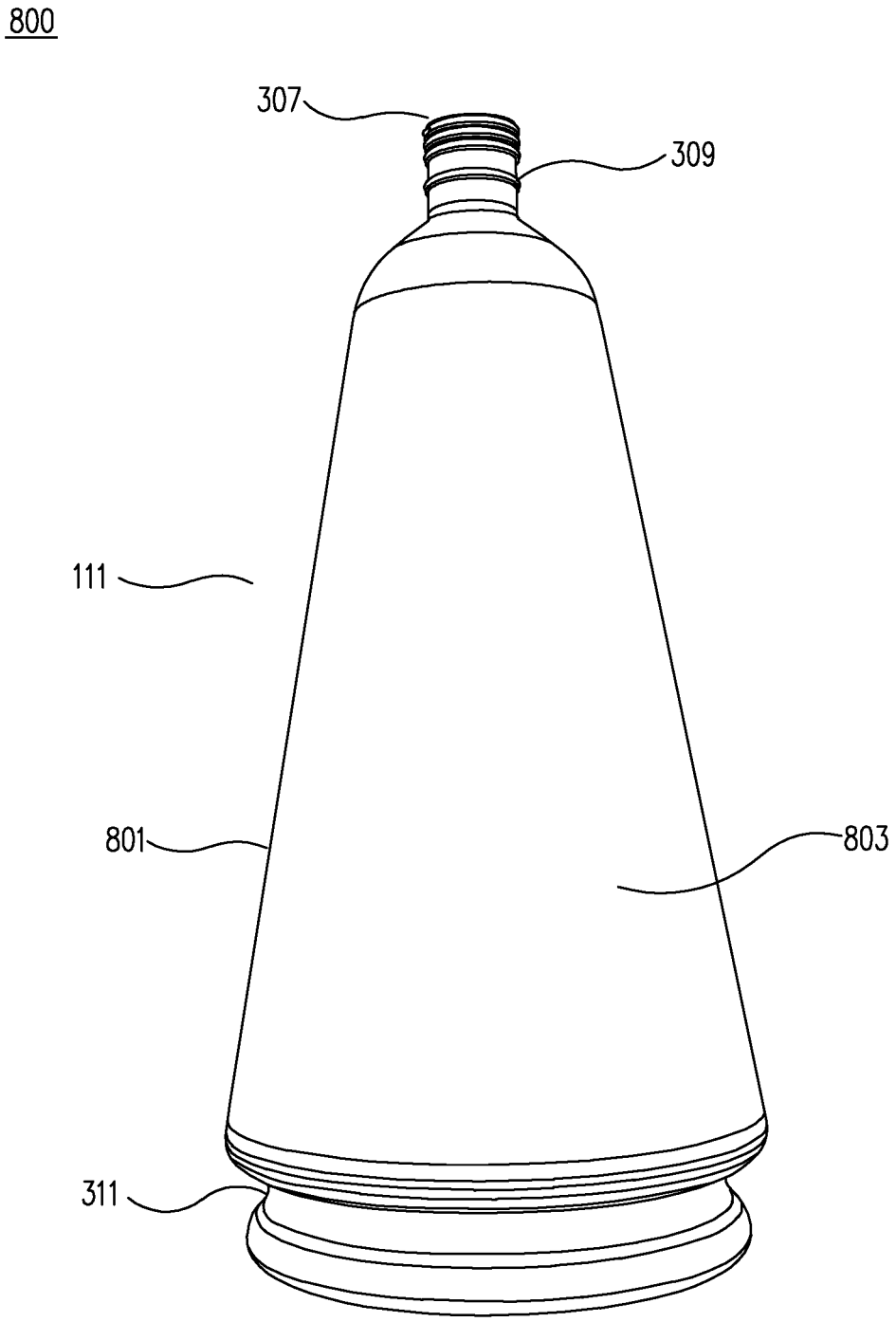
FIG. 8 is a view 800 of a liquid vessel of a liquid lamp, in accordance with one embodiment.

FIG. 8 is a view 800 of liquid vessel 111 of a liquid lamp, in accordance with one embodiment.

As shown in FIG. 8, in one embodiment, liquid vessel 111 includes vessel mouth 307, transfer bead 309, vessel clip notch 311, liquid vessel exterior 801 and liquid vessel interior 803, which will be discussed in detail below.

Referring to FIG. 2A, FIG. 3A, and FIG. 8 together, as noted above, while a particular shape of liquid vessel 111 is shown, it should be noted that liquid vessel 111 can be any shape desired, as long as it is capable of being securely suspended from a support structure, such as support structure 107, while filled or partially filled with liquids 204. In one embodiment, liquid vessel exterior 801 is made of glass, however in other embodiments, liquid vessel exterior 801 can be made out of any non-porous material that is capable of retaining its integrity when exposed to heat. In one embodiment, liquid vessel exterior 801 may be made of one or more types of material, as long as the material or combination of materials is capable of holding liquids of varying densities without compromising the integrity of liquid vessel 111 when exposed to heat. In one embodiment, the material of liquid vessel exterior 801 is fully clear or transparent so that the entirety of any contents of liquid vessel interior 803 can be viewed from a location exterior to liquid vessel 111. In one embodiment, liquid vessel exterior 801 is made from a translucent, semitransparent, frosted, or tinted material such that any contents of liquid vessel interior 803 can be at least partially viewed from a location exterior to liquid vessel 111. In one embodiment, liquid vessel exterior 801 is made of more than one type of material, wherein, one type of material is opaque, and the other type of material is transparent or semitransparent, such that at least part of any contents of liquid vessel interior 803 can be viewed from a location exterior to liquid vessel 111. As one illustrative example, an upper and/or lower portion of liquid vessel exterior 801 may be made of metal, while a portion in the middle may be made of glass, such that a window is created for viewing of any contents of liquid vessel interior 803.

In one embodiment, one or more liquids 204 are transferred into liquid vessel interior 803 through vessel mouth 307, such that liquid vessel interior 803 is at least partially filled with liquids 204. In one embodiment, one or more liquids 204 are transferred into liquid vessel interior 803, through vessel mouth 307 such that liquid vessel interior 803 is fully filled or mostly filled with liquids 204. In one embodiment, once one or more liquids 204 have been transferred into liquid vessel interior 803, vessel cap 302 is placed over vessel mouth 307 to prevent liquids 204 from spilling out of liquid vessel 111, should liquid vessel 111 be tipped over or jostled. In various embodiments, the liquid vessel cap 302 is able to be easily removed to allow the one or more liquids 204 to be refilled, replaced, or changed as needed and/or as desired.

In one embodiment, a clamp, such as, but not limited to, collar clamp 301, is secured around vessel mouth 307 and vessel cap 302, such that collar clamp 301 grips liquid vessel 111 securely around transfer bead 309, and vessel mouth 307 and vessel cap 302 rest within a cavity of collar clamp 301, as discussed above. In one embodiment, transfer bead 309 has a rook shape on a portion of the bead, and collar clamp 301 has an opposing rook shape on the portion of collar clamp 301 that clamps to transfer bead 309 (not shown). This configuration prevents collar clamp 301 from spinning around transfer bead 309, which in turn prevents wires of main power cord 101 from twisting within collar clamp 301. In one embodiment, bezel 205 is coupled to vessel clip notch 311, as will be discussed in additional detail below.

Figure 9A:
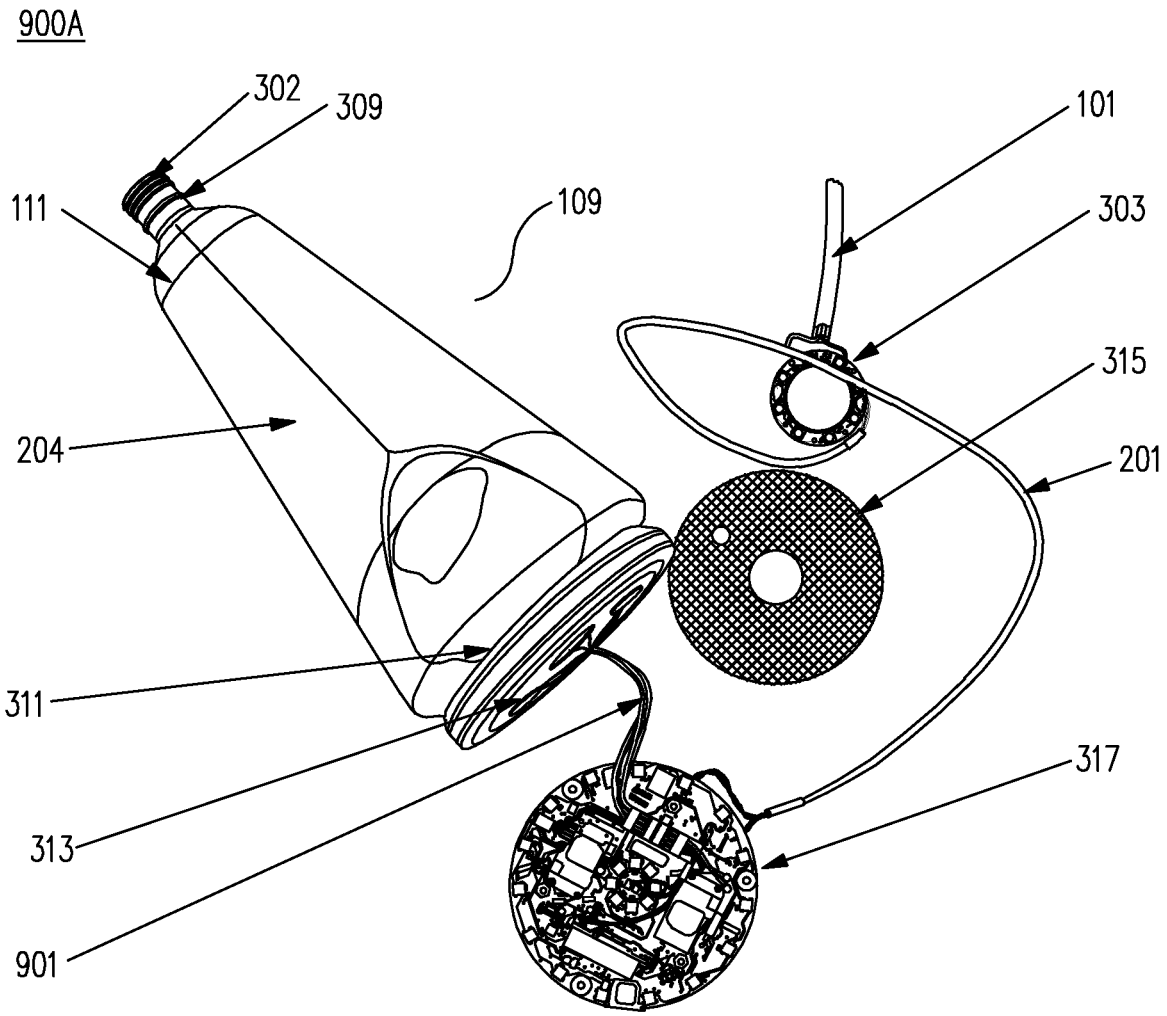
FIG. 9A is a view 900A of a partially disassembled liquid lamp, in accordance with one embodiment.

FIG. 9A is a view 900A of a partially disassembled liquid lamp 109, in accordance with one embodiment.

As shown in FIG. 9A, in one embodiment, main power cord 101 is electrically coupled to upper ring board 303 to provide power from the power source to the various components of liquid lamp 109. In one embodiment, upper ring board 303 is electrically coupled to main logic board 317 via main wire loom 201. In one embodiment, main wire loom 201 allows power from main power cord 101 to reach main logic board 317, and it also allows signals to be sent between upper ring board 303 and main logic board 317. In one embodiment, upper ring board 303 utilizes one or more thermistors (not shown) to sense temperature at the top of liquid vessel 111, and sends the temperature data from upper ring board 303 to main logic board 317 via main wire loom 201. In one embodiment, main logic board 317 sends signals to upper ring board 303 via main wire loom 201 to control the functioning of one or more LEDS on upper ring board 303. Further, in one embodiment, upper ring board 303 is capable of receiving touch signals from upper components of liquid lamp 109, and sending those signals to main logic board 317 via main wire loom 201. Other features of upper ring board 303 will be discussed in additional detail below.

In one embodiment, when upper ring board 303 is positioned around an upper portion of liquid vessel 111 such that it rests below transfer bead 309, main wire loom 201 runs down the body of liquid vessel 111 to connect with main logic board 317. In one embodiment, main wire loom 201 from upper ring board 303 to main logic board 317 is wrapped around the exterior body of liquid vessel 111. In one embodiment, main wire loom 201 runs straight down the exterior body of liquid vessel 111. In one embodiment, instead of being bundled in a loom, the electrical wires that make up main wire loom 201 are embedded within a surface of liquid vessel 111.

In one embodiment, a heating element, such as, but not limited to, thin film heater 313, is physically coupled to a bottom portion of liquid vessel 111, and is electrically coupled to main logic board 317 via heater wire loom 901. In one embodiment, thin film heater 313 is capable of being digitally controlled by main logic board 317, which sends and receives signals from thin film heater 313 and associated components via heater wire loom 901.

Referring to FIG. 3B and FIG. 9A together, in one embodiment, main logic board 317 is placed within bezel 205, heat insulator 315 is positioned on top of main logic board 317, and bezel 205 is coupled to the bottom of liquid vessel 111 at vessel clip notch 311, such that heat insulator 315 rests between thin film heater 313 and main logic board 317, to ensure that the heat generated from thin film heater 313 does not damage components of main logic board 317. Bezel 205 and associated components will be discussed in additional detail below. As discussed above, in one embodiment, liquids 204 are transferred into liquid vessel 111 via vessel mouth 307, and vessel cap 302 is secured to vessel mouth 307.

Figure 9B:
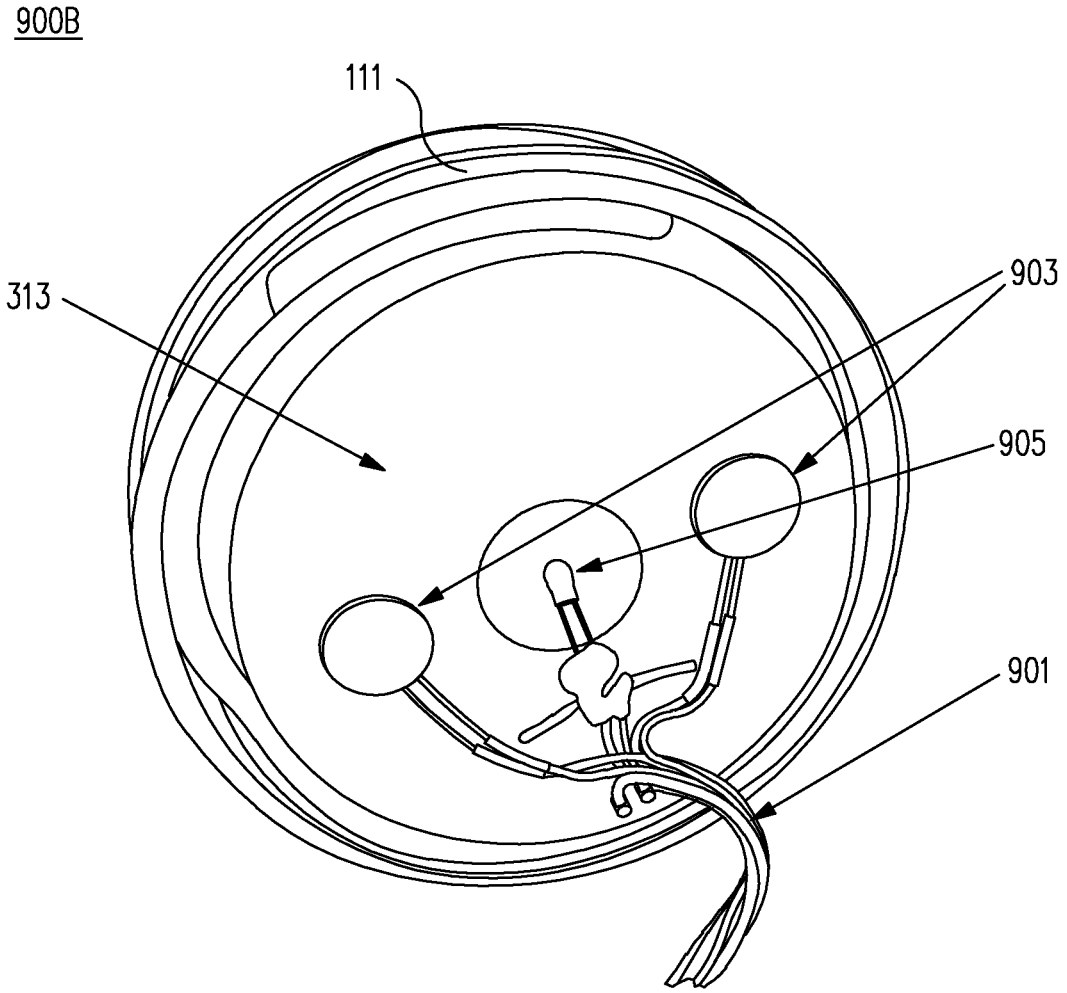
FIG. 9B is a view 900B of a thin film heater component of a liquid lamp, in accordance with one embodiment.

FIG. 9B is a view 900B of thin film heater 313 of a liquid lamp, in accordance with one embodiment.

Referring to FIG. 9A and FIG. 9B together, in one embodiment, thin film heater 313 generates the heat used to affect the movement and flow of liquids 204 inside of liquid vessel 111. As noted above, in traditional liquid lamps, an incandescent light bulb is used to generate heating for this purpose, however, this design not only wastes energy, but also severely limits the ability of liquid lamps to be provided in alternative form factors. Additionally, this traditional design prevents the liquid lamp from being able to provide digital control of light and heat elements, and prevents the liquid lamp from being able to provide multimedia and/or IoT features.

In one embodiment, thin film heater 313 is paper-thin and couples to a bottom exterior portion of liquid vessel 111 via a coupling mechanism, such as, but not limited to, an adhesive. In other embodiments, the heating source can be any type of heating source as currently known and/or as developed after the time of filing, as long as the heating source is able to affect the flow of liquids 204 within liquid vessel 111, is small enough to couple to a bottom exterior portion of liquid vessel 111, and is able to be digitally controlled by main logic board 317, without damaging the electronic components of main logic board 317.

In one embodiment, one or more thermistors are affixed to or positioned on or near a bottom exterior portion of liquid vessel 111 to measure temperature at various locations towards the lower end of liquid lamp 109. For example, in FIG. 9B, heater thermistors 903 measure the temperature of the thin film heating element itself, while lower vessel thermistor 905 measures the temperature of a bottom exterior portion of liquid vessel 111. In various embodiments, signals from heater thermistors 903 and lower vessel thermistor 905 are sent to main logic board 317 via heater wire loom 901. In various embodiments, any number of thermistors may be utilized, depending on the sensor data needed to adequately control the temperature of the liquids 204 in liquid vessel 111 and to provide any other desired features. Mechanisms, logic components, and processes for controlling temperature and providing other features will be addressed below in the detailed discussion of upper ring board 303 and main logic board 317.

FIG. 10A through 10F are views of a lower bezel component of a hanging liquid lamp, in accordance with one embodiment.

Figure 10A:
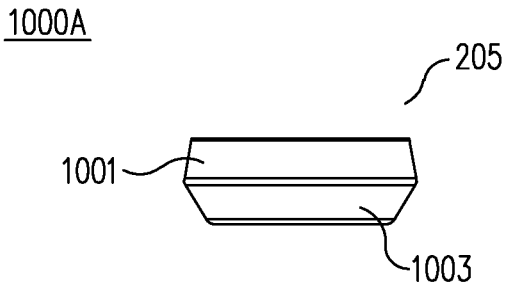
FIG. 10A through 10F are views of a bezel component of a liquid lamp, in accordance with one embodiment.

More particularly, FIG. 10A is a front view 1000A of bezel 205 of a liquid lamp, in accordance with one embodiment.

Figure 10B:
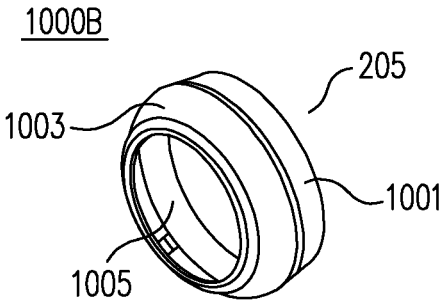

FIG. 10B is a perspective view 1000B of bezel 205 of a liquid lamp, in accordance with one embodiment.

Figure 10C:
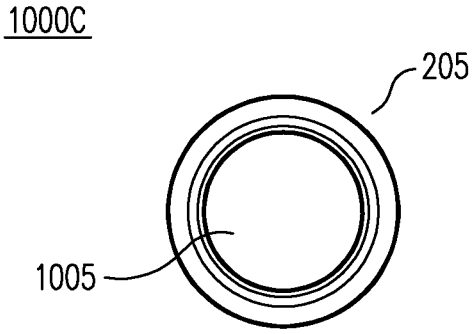

FIG. 10C is a bottom view 1000C of bezel 205 of a liquid lamp, in accordance with one embodiment.

Figure 10D:
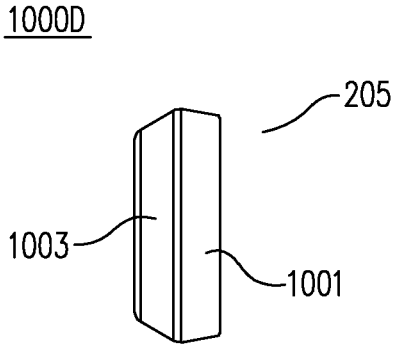

FIG. 10D is a side view 1000D of bezel 205 of a liquid lamp, in accordance with one embodiment.

Figure 10E:
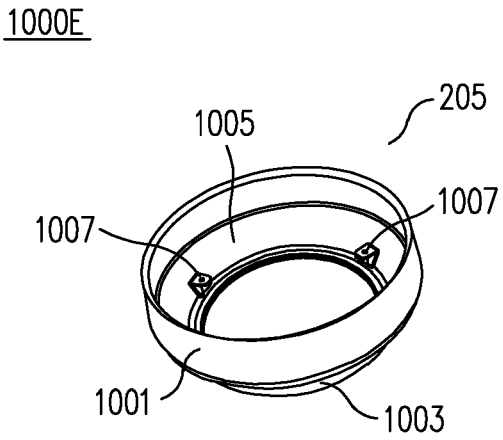

FIG. 10E is an upper perspective view 1000E of bezel 205 of a liquid lamp, in accordance with one embodiment.

Figure 10F:
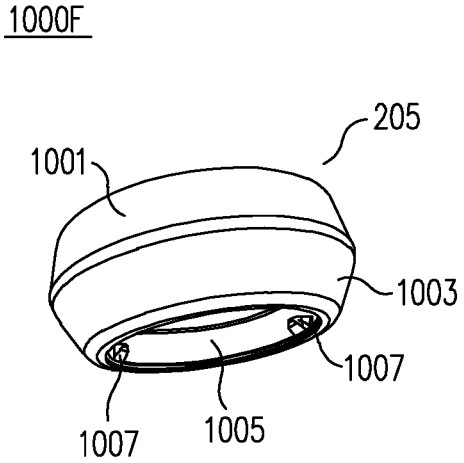

FIG. 10F is a lower perspective view 1000F of bezel 205 of a liquid lamp, in accordance with one embodiment.

As shown in FIG. 10A through FIG. 10F, in various embodiments, bezel 205 includes bezel upper half 1001, bezel lower half 1003, bezel cavity 1005, and bezel clip prong mount points 1007, which will be discussed in additional detail below.

Figure 11A:
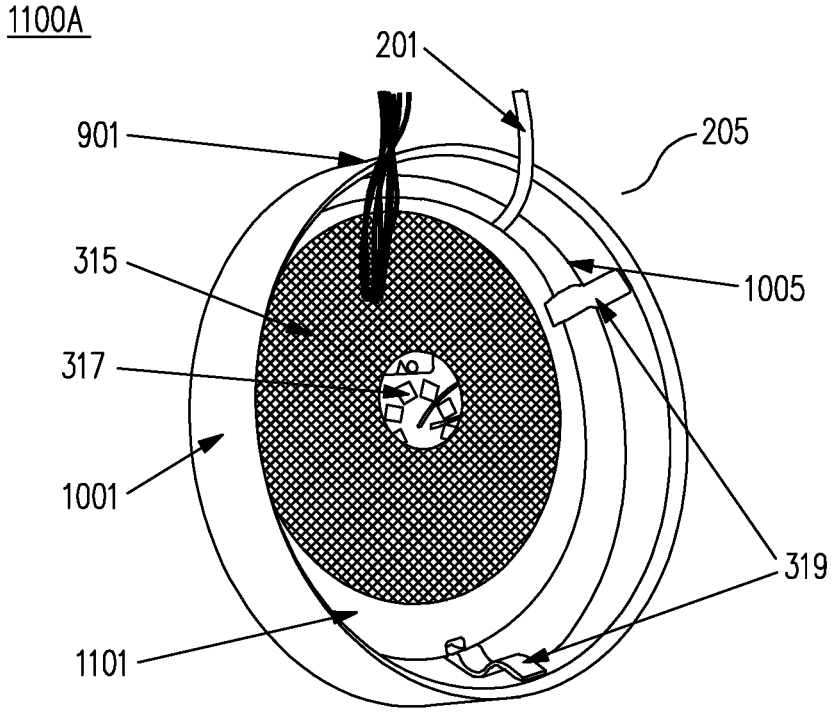
FIG. 11A is a view of an upper half of a bezel component with additional components housed inside, in accordance with one embodiment.

FIG. 11A is a view 1100A of bezel upper half 1001 with additional components housed inside, in accordance with one embodiment.

Figure 11B:
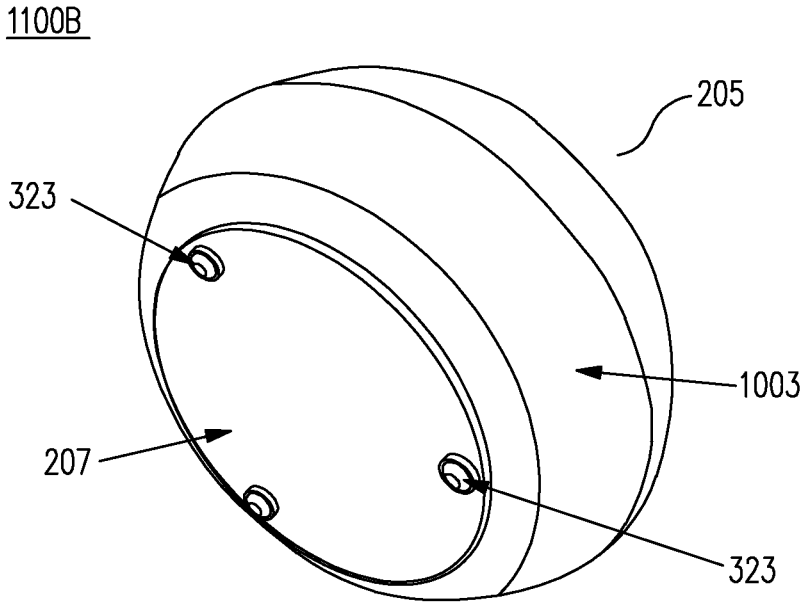
FIG. 11B is a view 1100B of a lower half of a bezel component with a lens in place, in accordance with one embodiment.

FIG. 11B is a view 1100B of bezel lower half 1003 with lens 207 in place, in accordance with one embodiment.

Referring to FIG. 3A, FIG. 10A through FIG. 10F, FIG. 11A, and FIG. 11B together, in one embodiment, bezel cavity 1005 is utilized to house several key components of liquid lamp 109. In one embodiment, as partially shown in FIG. 11A, main logic board 317 is placed within bezel cavity 1005 through an opening in a top portion of bezel upper half 1001, such that one or more LEDs present on an upward facing side of main logic board 317 are able to project light upwards into liquid vessel 111, and one or more LEDs present on a downward facing side of main logic board 317 are able to project light onto a surface or area below liquid lamp 109 through an opening in a bottom portion of bezel lower half 1003. In one embodiment, diffuser 1101 is placed within bezel cavity 1005 around the circumference or perimeter of main logic board 317 (depending on the shape of main logic board 317), to soften the light that is projected downward. In one embodiment, no LEDs are present on a downward facing side of main logic board 317, and so no light is projected downward from main logic board 317 onto a surface or area below liquid lamp 109. In one embodiment, heat insulator 315 is placed within bezel cavity 1005, and rests on top of an upward facing side of main logic board 317. In one embodiment, heat insulator 315 is shaped such that light from one or more LEDs present on an upward facing side of main logic board 317 is able to be projected upward through liquid vessel 111. In one embodiment, no LEDs are present on an upward facing side of main logic board 317, and so no light is projected upward from main logic board 317. In one embodiment, if no LEDs are present on an upward facing side of main logic board 317, then any shape of heat insulator 315 can be used, as long as it fits within bezel cavity 1005 of bezel 205 such that main logic board 317 is adequately protected from heat damage.

As discussed above, in one embodiment, thin film heater 313 is affixed to a bottom exterior surface of liquid vessel 111, and is electrically coupled to main logic board 317 via heater wire loom 901, while main wire loom 201 electrically couples main logic board 317 to upper ring board 303. As shown in FIG. 11A, in one embodiment, wiring such as, but not limited to, main wire loom 201 and/or heater wire loom 901 can either be passed through heat insulator 315 or around heat insulator 315 to couple with main logic board 317 within bezel cavity 1005.

As shown in FIG. 3A, FIG. 3B, FIG. 11A, and FIG. 11B, in one embodiment, liquid lamp 109 includes lens 207 which is utilized to assist liquid lamp 109 in projecting light from any downward facing LEDs of main logic board 317 onto a surface or area below liquid lamp 109. In one embodiment, lens 207 is situated just below an opening in a bottom section of bezel lower half 1003. In one embodiment, lens 207 is coupled directly to bezel lower half 1003. In other embodiments, lens 207 is coupled directly to main logic board 317 via one or more lens coupling components 323, such that lens 207 rests in, near, or below an opening in the bottom section of bezel lower half 1003, while main logic board 317 rests within bezel cavity 1005 of bezel lower half 1003. In some embodiments, lens 207 may not be present, and light from LEDs on the downward facing side of main logic board 317 may be allowed to project directly downward, through an opening in a bottom section of bezel lower half 1003. In other embodiments, especially when no LEDs are present on the downward facing side of main logic board 317, lens 207 may not be present, there may be no opening in the bottom portion of bezel lower half 1003, and/or the bottom portion of bezel lower half 1003 may be a solid opaque material that functions to secure main logic board 317 in place, but does not provide for the projection of light through a bottom portion of bezel lower half 1003.

As mentioned above, in one embodiment, a top opening in a portion of bezel upper half 1001 of bezel 205 enables liquid lamp 109 components such as, but not limited to, main logic board 317, diffuser 1101, and heat insulator 315 to be placed and/or secured within bezel cavity 1005 of bezel 205. In one embodiment, once one or more liquid lamp components, such as, but not limited to, main logic board 317, diffuser 1101, and heat insulator 315, are secured within bezel 205, bezel 205 is coupled to a lower portion of liquid vessel 111, such as vessel clip notch 311 by any means as currently known and/or as developed after the time of filing for coupling physical components together. As noted above, in some embodiments, thin film heater 313 is affixed to a bottom exterior surface of liquid vessel 111, such that, when bezel 205 is coupled to vessel clip notch 311, thin film heater 313 rests within an upper portion of bezel cavity 1005, on top of heat insulator 315, thus allowing the liquids in liquid vessel 111 to be heated, while protecting main logic board 317 from the heat generated by thin film heater 313.

In one embodiment, bezel 205 couples to the lower portion of liquid vessel 111 by any coupling mechanism that is capable of reliably securing bezel 205 to the lower portion of liquid vessel 111. In one embodiment, the means for coupling bezel 205 to the lower portion of liquid vessel 111 includes vessel clip notch 311 and bezel ring clip assembly 321 (See FIG. 3A). In one embodiment, bezel ring clip assembly 321 is a ring-like structure which has attached thereon one or more individual bezel clip prongs 319. In one embodiment, bezel clip prongs 319 are part of the ring-like structure, while in other embodiments, bezel clip prongs 319 are separate components that can be attached to the ring-like structure to form bezel ring clip assembly 321.

FIG. 12A through 12E are views of a bezel clip prong component of a liquid lamp, in accordance with one embodiment.

Figure 12A:
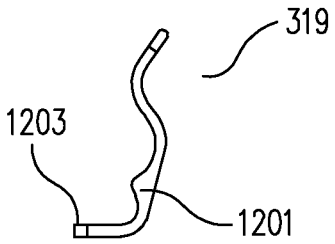
FIG. 12A through 12E are views of a bezel clip prong component of a liquid lamp, in accordance with one embodiment.

More particularly, FIG. 12A is a front view 1200A of a bezel clip prong 319 of a liquid lamp, in accordance with one embodiment.

Figure 12B:
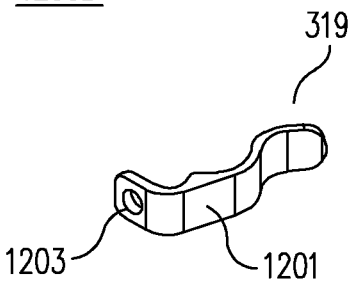

FIG. 12B is a perspective view 1200B of a bezel clip prong 319 of a liquid lamp, in accordance with one embodiment.

Figure 12C:
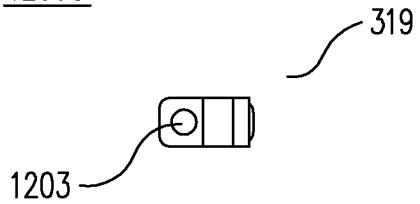

FIG. 12C is a top view 1200C of a bezel clip prong 319 of a liquid lamp, in accordance with one embodiment.

Figure 12D:
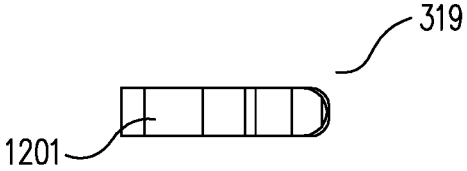

FIG. 12D is a side view 1200D of a bezel clip prong 319 of a liquid lamp, in accordance with one embodiment.

Figure 12E:
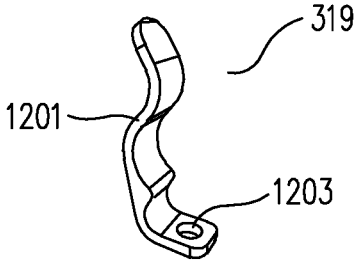

FIG. 12E is an upper perspective view 1200E of a bezel clip prong 319 of a liquid lamp, in accordance with one embodiment.

In one embodiment, bezel clip prong 319 includes bezel clip prong body 1201 and bezel clip prong mount end 1203. Referring to FIG. 3A, FIG. 3B, FIG. 10E, and FIG. 12A through FIG. 12E together, in one embodiment, one or more bezel clip prongs 319 are secured to bezel ring clip assembly 321, and bezel clip prong mount ends 1203 of bezel clip prongs 319 are fastened to bezel clip prong mount points 1007 of bezel 205, such that bezel ring clip assembly 321 is secured to the bezel 205 within bezel cavity 1005. In one embodiment, ring clip coupling components 325 are utilized secure bezel ring clip assembly 321 to bezel cavity 1005. In various embodiments, the unique shape of bezel clip body 1201 allows bezel clip prongs 319 to securely couple bezel 205 to liquid vessel 111 at vessel clip notch 311 of liquid vessel 111.

In various embodiments, the above described design of bezel 205 allows the logic, lighting, and heating elements utilized by liquid lamp 109 to be easily coupled with liquid vessel 111, such that minimal space is used to house the elements, and the logic elements are protected from the heating elements. Additionally, in some embodiments, an outer surface of bezel 205 functions as a touch sensor which connects to one or more touch sensor controls on main logic board 317, which allows bezel 205 to be used to control various features of liquid lamp 109. In some embodiments, main logic board 317 allows bezel 205 to provide haptic feedback to a user when the touch sensing ability of bezel 205 is activated. In some embodiments, the haptic feedback provided through bezel 205 is utilized to inform users that commands being provided by the user are acknowledged. Additional details regarding the features of main logic board 317 will be discussed further below.

Figure 13:
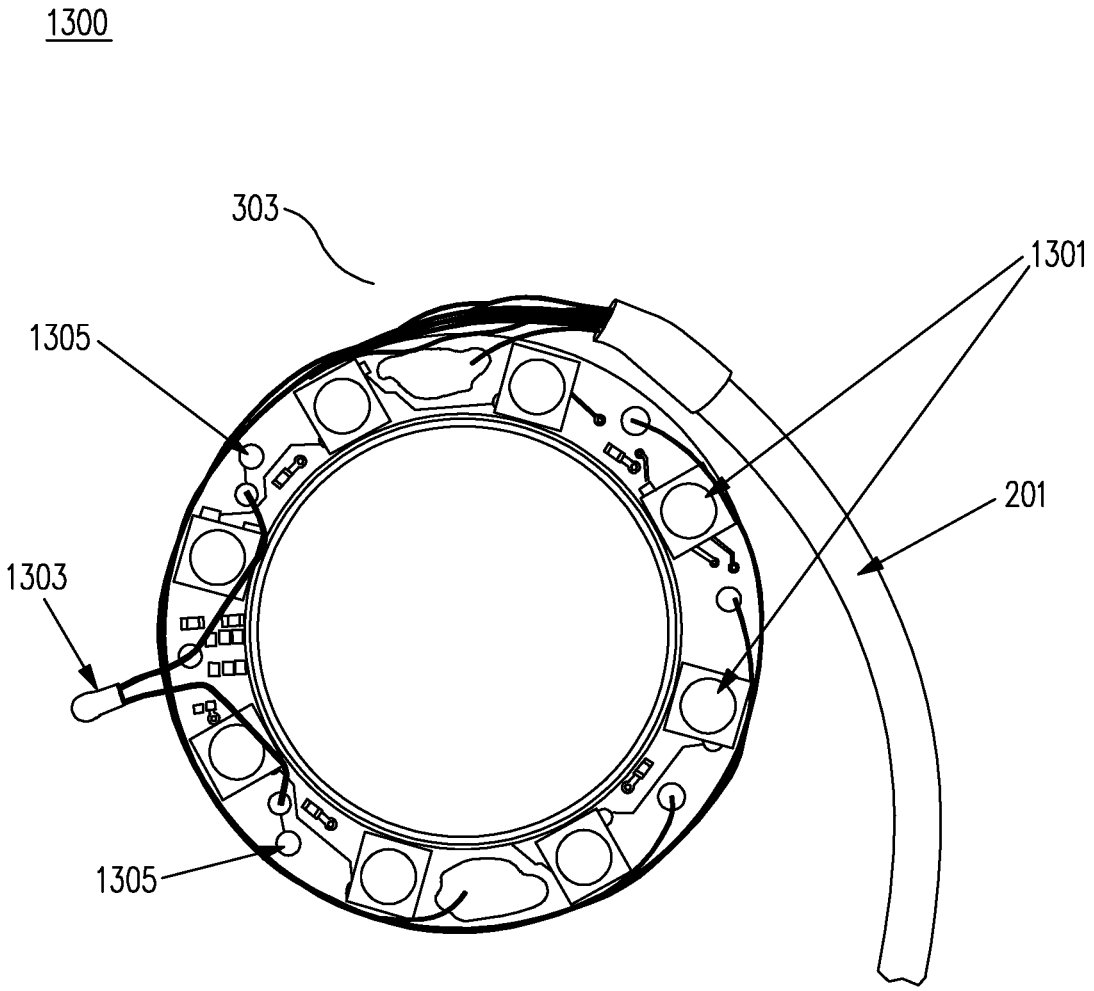
FIG. 13 is a view of an upper ring board of a liquid lamp, in accordance with one embodiment.

FIG. 13 is a view 1300 of upper ring board 303 of a liquid lamp, in accordance with one embodiment.

As shown in FIG. 13, in one embodiment, upper ring board 303 includes ring board LEDs 1301, ring board thermistor 1303, ring board touch sensor controls 1305, and main wire loom 201, which will be discussed in additional detail below.

Referring to FIG. 7, FIG. 9A and FIG. 13 together, in one embodiment, upper ring board 303 includes main wire loom 201, which is electrically coupled to upper ring board 303 at one end, and can be electrically coupled to main logic board 317 at the other end. As discussed above, in one embodiment, main wire loom 201 enables bi-directional communication between upper ring board 303 and main logic board 317, which will be discussed in additional detail below. In one embodiment, main power cord 101 is electrically coupled to upper ring board 303, which ensures that power from main power cord 101 reaches both upper ring board 303 and main logic board 317, through main wire loom 201.

In one embodiment, upper ring board 303 is a circuit board, which, at a minimum, provides temperature sensing capabilities. In one embodiment, the circuit board can be any shape or dimensions desired, as long as it is capable of sensing temperature at a top portion of liquid vessel 111. In one embodiment, the circuit board is shaped like a ring, as in the embodiment of FIG. 13, which depicts one embodiment of upper ring board 303. In one embodiment, having the shape of a ring allows upper ring board 303 to be placed over the mouth of a vessel, such liquid vessel 111. Placing a circuit board with temperature sensing capabilities, such as upper ring board 303, over vessel the mouth of liquid vessel 111 allows upper ring board 303 to measure temperature at a top portion of liquid vessel 111. Temperature data from the top of liquid vessel 111 can then be sent to main logic board 317 through main wire loom 201, for further processing. In one embodiment, temperature at the top of liquid vessel 111 is measured using one or more thermistors, such as ring board thermistor 1303. In one embodiment, ring board thermistor 1303 is coupled to upper ring board 303 on a downward facing surface of upper ring board 303, such that ring board thermistor 1303 touches a top portion of liquid vessel 111 when placed over the mouth of liquid vessel 111. In various other embodiments, any type of mechanism for measuring temperature at the top of liquid vessel 111 can be used, as currently known and/or as developed after the time of filing.

In one embodiment, in addition to having temperature sensing capabilities, upper ring board 303 also has lighting capabilities. In one embodiment, lighting is provided by one or more LEDs, such as ring board LEDs 1301, which may be placed at any location on upper ring board 303. In one embodiment, ring board LEDs 1301 are placed around the circumference of a surface of upper ring board 303. In one embodiment, ring board LEDs 1301 are placed on a downward facing surface of upper ring board 303, such that when upper ring board 303 is placed over the mouth of liquid vessel 111 and ring board LEDs 1301 are activated, light produced from ring board LEDs 1301 shines downward, into the body of liquid vessel 111. Further, in some embodiments, upper ring board 303 may not contain any LEDs, as other portions of the liquid lamp can be relied upon to provide lighting.

In one embodiment, each LED of ring board LEDs 1301 is capable of producing a singular color. In one embodiment, each LED of ring board LEDs 1301 is capable producing more than one color. In various other embodiments, each LED of ring board LEDs 1301 is capable of producing hundreds, thousands, or millions of different colors. In one embodiment, one or more of the LEDs of ring board LEDs 1301 is able to produce UV-A ultraviolet light. In one embodiment, control signals are sent to upper ring board 303 from main logic board 317, via main wire loom 201 to control the operation of ring board LEDs 1301. In one embodiment, upper ring board 303 includes one or more touch sensor controls 1305, which allow for operation of ring board LEDs 1301 through one or more touch-based commands. Various control signals capable of being sent to upper ring board 303 from main logic board 317 will be discussed in additional detail below.

Figure 14A:
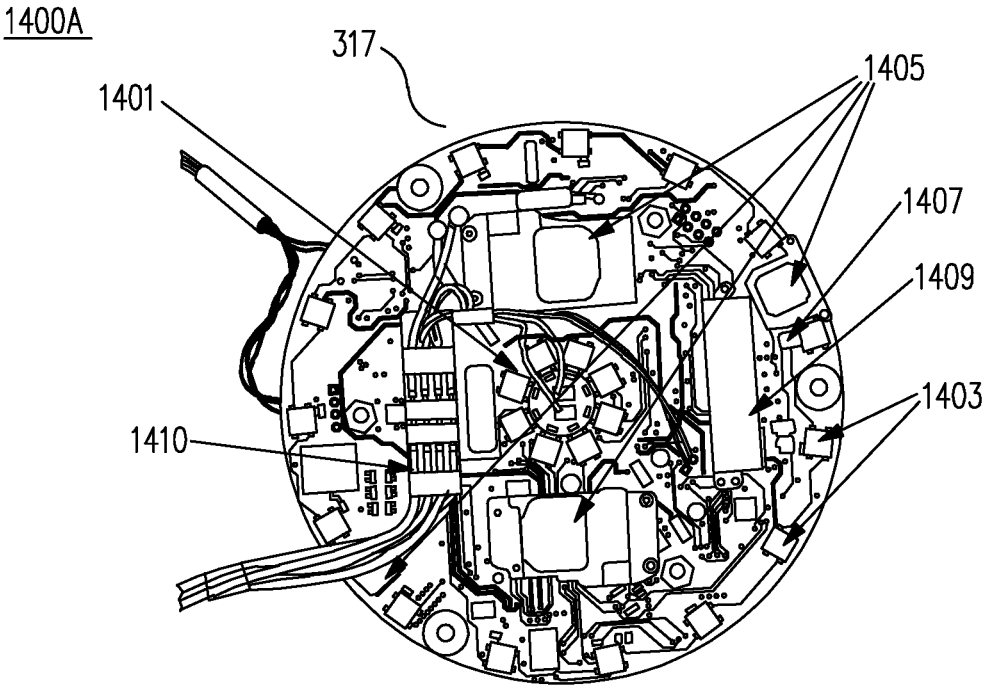
FIG. 14A is a view of an upward facing side of a liquid lamp main logic board component, in accordance with one embodiment.

FIG. 14A is a view 1400A of an upward facing side of a liquid lamp main logic board 317 component, in accordance with one embodiment.

Figure 14B:
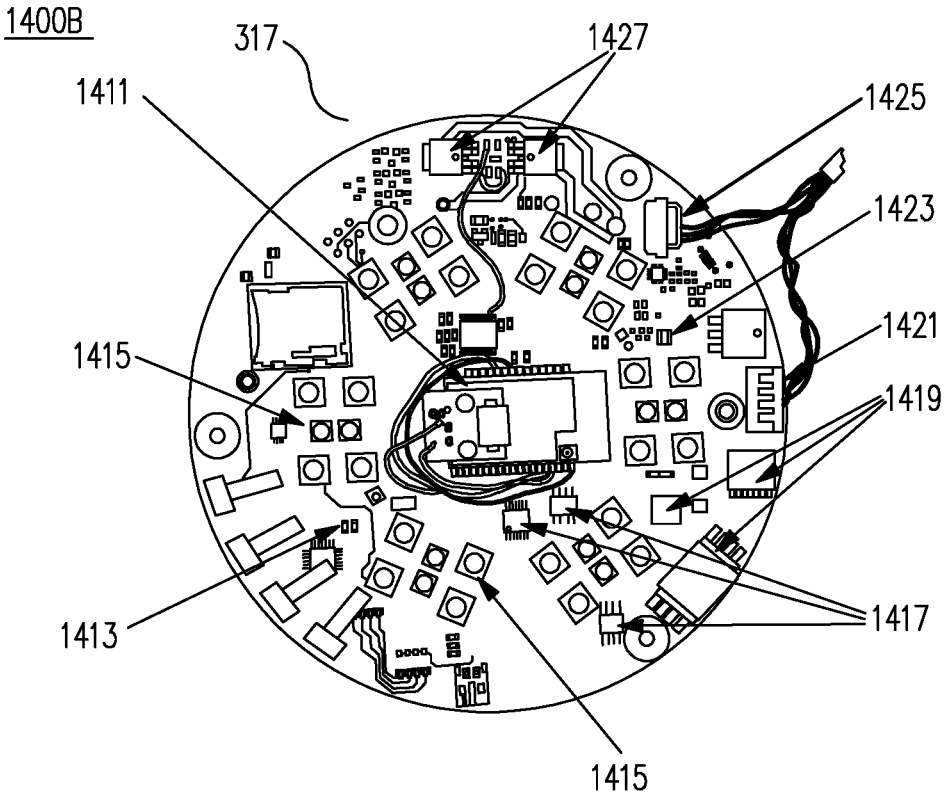
FIG. 14B is a view of a downward facing side of a liquid lamp main logic board component, in accordance with one embodiment.

FIG. 14B is a view 1400B of a downward facing side of a liquid lamp main logic board 317 component, in accordance with one embodiment.

In the embodiment of FIG. 14A and FIG. 14B, main logic board 317 is depicted as circular in shape, and the various logic board components are positioned in certain locations on main logic board 317. It should be noted that the embodiment shown in FIG. 14A and FIG. 14B is provided for illustrative purposes only and is not intended to limit the scope of the invention as disclosed and as claimed herein. Thus, while main logic board 317 is shown in a specific shape, and various components of main logic board 317 are arranged at particular locations on main logic board 317, one of ordinary skill in the art will readily recognize that main logic board 317 can be any shape desired, likely determined by the shape of the liquid vessel, and the various electronic components of main logic board 317 can be positioned in any position and/or configuration that allows for the intended functionality.

As shown in FIG. 14A, in one embodiment, an upward facing side of main logic board 317 includes upper inner logic board LED ring 1401, upper outer logic board LED ring 1403, logic board speakers 1405, logic board microphone 1407, logic board haptic feedback 1409, and heater wire loom plug 1410, each of which will be discussed in additional detail below.

As shown in FIG. 14B, in one embodiment, a downward facing side of main logic board 317 includes multimedia wireless network engine 1411, multimedia amplifier and haptic control 1413, lower logic board LED clusters 1415, logic board lighting control 1417, logic board power supplies 1419, logic board power input 1421, logic board touch sensor control chip 1423, ring board plug 1425, and logic board heater control 1427, each of which will be discussed in additional detail below.

Referring to FIG. 13, FIG. 14A and FIG. 14B together, in one embodiment, main logic board 317 includes logic board power input 1421, which connects to power wires in main wire loom 201 from upper ring board 303 to enable power to flow from a power source into one or more power supplies on main logic board 317, such as logic board power supplies 1419. In one embodiment, main logic board 317 also includes ring board plug 1425, which connects to signal wires in main wire loom 201, thereby allowing main logic board 317 to communicate with upper ring board 303.

As noted above, the key components of main logic board 317 are the components that allow for digital control of the heating and lighting elements of the liquid lamp. In various embodiments, the heating and lighting elements of the liquid lamp are able to be digitally controlled by a user of the liquid lamp, using any electronic device capable of communicating with components of main logic board 317. In various embodiments, lighting components of the liquid lamp disclosed herein may include one or more of: lighting elements provided by upper ring board 303 (as shown in FIG. 13), lighting elements provided by an upward facing side of main logic board 317 (as shown in FIG. 14A), lighting elements provided by a downward facing side of main logic board 317 (as shown in FIG. 14B), and one or more support logic chips on main logic board 317 to drive the lighting components.

In one embodiment, the upward facing side of main logic board 317 may include upper inner logic board LED ring 1401 and upper outer logic board LED ring 1403. Together, these lighting rings allow for light to be projected upward from main logic board 317, into the body of the liquid vessel. Although in the embodiment of FIG. 14A, the LEDs are arranged in inner and outer ring shaped groupings (which correspond to a circular shape of main logic board 317) it should be noted that any number of LEDs or LED groupings, arranged in any type of configuration desired may be present on the upward facing side of main logic board 317. In one embodiment, the groupings and positioning of the upward facing LEDs may be at least partially determined by the shape of main logic board 317 and/or the shape of the liquid lamp. Further, in some embodiments, main logic board 317 may not contain upward facing LEDs, as other portions of the liquid lamp can be relied upon to provide lighting.

In one embodiment, the downward facing side of main logic board 317 may include one or more lower logic board LED clusters 1415, which allow for light to be projected downward from main logic board 317, onto a surface or area below the liquid lamp or around the lower end of the liquid lamp. As discussed above, in one embodiment, a lens is coupled to the downward facing side of main logic board 317, and the lens is placed through a downward facing opening in a bezel that is coupled to the liquid vessel thus allowing light to be projected downwards from the lower end of the liquid lamp. Although in the embodiment of FIG. 14B, the LEDs are arranged in six clusters of six LEDs, it should be noted that any number of LEDs or LED groupings, arranged in any type of configuration desired may be present on the downward facing side of main logic board 317. In one embodiment, the groupings and positioning of the downward facing LEDs may be at least partially determined by the shape of main logic board 317 and/or the shape of the liquid lamp. Further, in some embodiments, main logic board 317 may not contain downward facing LEDs, as other portions of the liquid lamp can be relied upon to provide lighting.

In various embodiments, the one or more lower logic board LED clusters 1415 each include one or more color producing LEDs and one or more cool or white light LEDS that allow for control over the coolness and warmth of the generated light. As noted above with respect to the LEDs on the ring board, in one embodiment, each LED on main logic board 317 is capable of producing a singular color. In one embodiment, each LED on main logic board 317 is capable producing more than one color. In various other embodiments, each LED on main logic board 317 is capable of producing hundreds, thousands, or millions of different colors. In one embodiment, one or more LEDs on main logic board 317 is able to produce UV-A ultraviolet light.

In various embodiments, the support logic chips to drive the lighting components include one or more logic board lighting control chips 1417. In one embodiment, the one or more logic board lighting control chips 1417 are responsible for setting the color of each LED on main logic board 317, as well as each LED on the ring board. In some embodiments, one or more individual LEDs or groups of LEDs are either on or off, while in other embodiments, one or more of the LEDs or groups of LEDs may alternate between on and off to produce a flashing effect. In one embodiment, the logic board lighting control chips 1417 are responsible for controlling the timing of turning the LEDs on or and off and/or controlling the timing of any flashing effects. In one embodiment, main logic board 317 includes one or more microphones, such as logic board microphone 1407, and the LEDs can change color and/or flash at different speeds and/or rhythms based on sounds picked up by logic board microphone 1407. As one illustrative example, logic board lighting control chips 1417 may synchronize changing of colors or flashing across multiple liquid lamps based on ambient music or voice commands. In one embodiment, one or more touch sensors, such as touch sensors controlled by logic board touch sensor control chip 1423, can be utilized to send commands to the one or more logic board lighting control chips 1417.

Referring now to FIG. 9B, FIG. 13, FIG. 14A, and FIG. 14B together, in one embodiment, heater wire loom 901 is coupled to thin film heater 313, heater thermistors 903, and lower glass thermistor 905 at one end, and at the other end is connected to heater wire loom plug 1410, which in one embodiment is integrated into the upward facing side of main logic board 317, as shown in FIG. 14A. In one embodiment logic board heater controls 1127 are integrated into the lower facing side of main logic board 317. Further, one or more additional thermistors (not shown) may also be present on main logic board 317. These elements, together with ring board thermistor 1303, allow for digital control of the heat generated by thin film heater 313.

As noted above, in one embodiment, ring board thermistor 1303 measures the temperature at a top portion of liquid vessel 111, and sends upper vessel temperature data from upper ring board 303 down to logic board heater controls 1427 of main logic board 317 via main wire loom 201. In one embodiment, lower vessel thermistor 905 measures the temperature at a lower portion of liquid vessel 111, and sends lower vessel temperature data from lower vessel thermistor 905 to logic board heater controls 1427 of main logic board 317 through wires in heater wire loom 901. In one embodiment, a third thermistor (not shown) on main logic board 317 measures the ambient temperature, and sends ambient temperature to logic board heater controls 1427.

Figure 15:
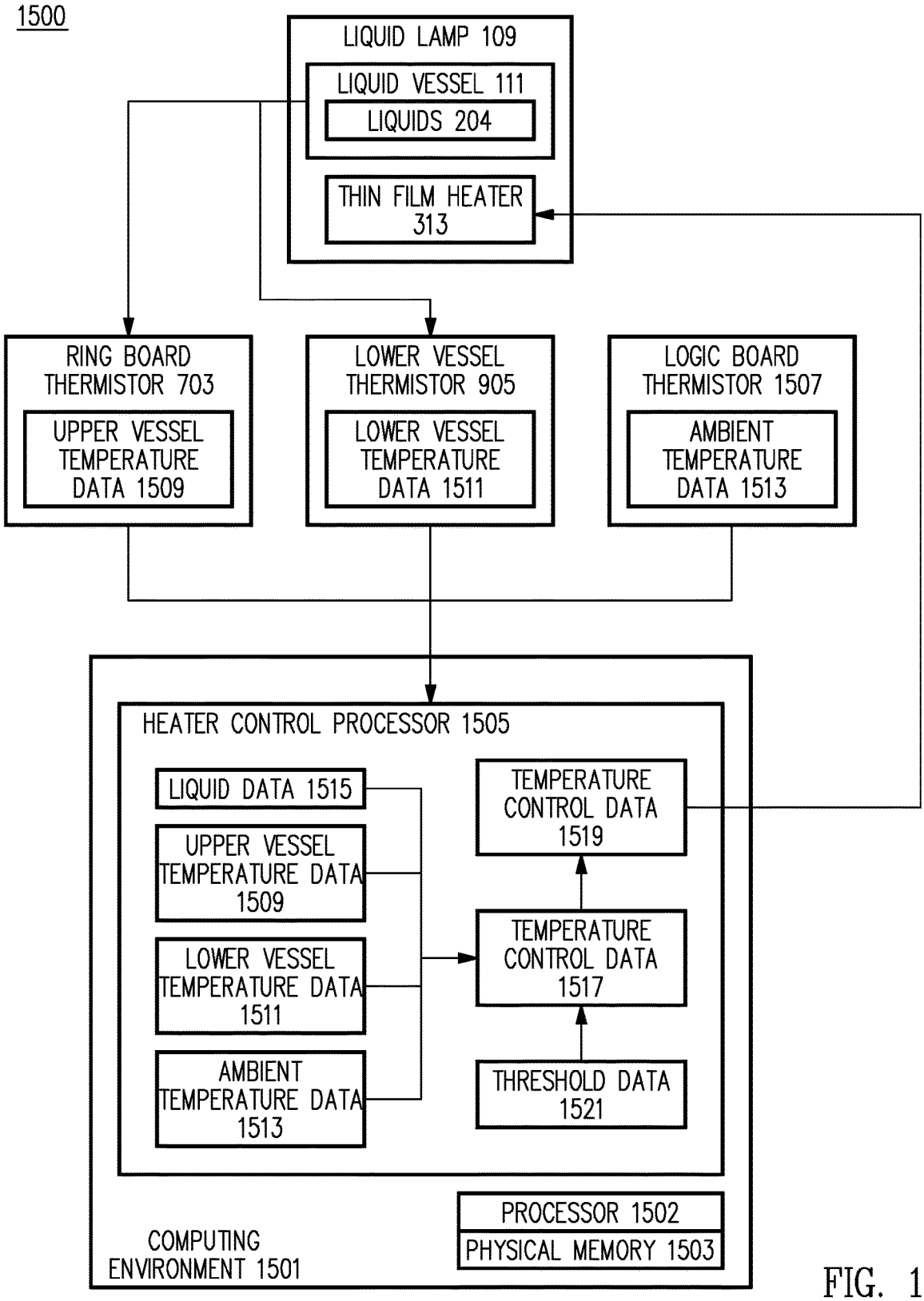
FIG. 15 is a block diagram 1500 illustrating a system for controlling the heat output of a thin film heater of a liquid lamp, in accordance with one embodiment.

FIG. 15 is a block diagram 1500 illustrating a system for controlling the heat output of thin film heater 313 of liquid lamp 109, in accordance with one embodiment.

As shown in FIG. 15, in one embodiment, computing environment 1501 includes processor 1502, physical memory 1503, and heater control processor 1505. In one embodiment, ring board thermistor 703 measures the temperature at an upper portion of liquid vessel 111 to generate upper vessel temperature data 1509, and upper vessel temperature data 1509 is sent to heater control processor 1505 for further processing. In one embodiment, lower vessel thermistor 905 measures the temperature at a lower portion of liquid vessel 111 to generate lower vessel temperature data 1511, and lower vessel temperature data 1511 is sent to heater control processor 1505 for further processing. In one embodiment, logic board thermistor 1507 measures ambient temperature to generate ambient temperature data 1513, and ambient temperature data 513 is sent to heater control processor 1505 for further processing.

In one embodiment, liquid data 1515, which represents data related to two or more liquids 204 inside of liquid vessel 111, is also provided to heater control processor 1505. In one embodiment, temperature control module 1517 processes liquid data 1515, upper vessel temperature data 1509, lower vessel temperature data 1511, and ambient temperature data 1513, to generate temperature control data 1519, which, in one embodiment, represents data indicating a desired heat output for thin film heater 313. In one embodiment, temperature control data 1519 is then provided to thin film heater 313, and thin film heater 313 adjusts heat output accordingly.

In various embodiments, it is important to provide liquid data 1515 to heater control processor 1505, because one combination of liquids 204 (master and ooze) will likely behave differently than another combination of liquids 204 when heated to the same temperature. In one embodiment, temperature control module 1517 calculates the differential between upper vessel temperature data 1509 and lower vessel temperature data 1511, and adjusts the resulting data value based on ambient temperature data 1513.

In one embodiment, temperature control module 1517 has access to threshold data 1521 which represents data indicating the amount of heat that thin film heater 313 should be outputting in order to achieve specific visual effects for different liquid combinations. As one example, a particular combination of liquids 204 may produce a first type of desired visual effect at a lower temperature, and a second type of desired visual effect at a higher temperature. Thus, if a user of the liquid lamp 109 wishes to produce the second type of desired visual effect, temperature control module 1517 will check threshold data 1521 related to the liquid combination represented by liquid data 1515 to determine whether the adjusted temperature differential is within a range of values needed to produce or continue producing the second type of desired visual effect. In one embodiment, if the adjusted temperature differential is not within the range of values needed to produce the second desired visual effect, temperature control module 1517 then makes a determination as to the amount of heat that should be provided by thin film heater 313 to achieve the desired visual effect within liquid vessel 111 and generates temperature control data 1519 based on this determination. In one embodiment, temperature control data 1519 is then sent to thin film heater 313 to make any needed adjustments in heat output. In one embodiment, while liquid lamp 109 is powered on, heater control processor 1505 continually monitors the thermistor data to ensure that the adjusted temperature differential remains within the predetermined range for producing the desired visual effect. In various embodiments, this allows the liquid lamp 109 to be actively pumping liquids 204 for very long periods of time without causing any damage to the liquid lamp or its various components, which is a key improvement over current and traditional liquid lamps.

Figure 16:
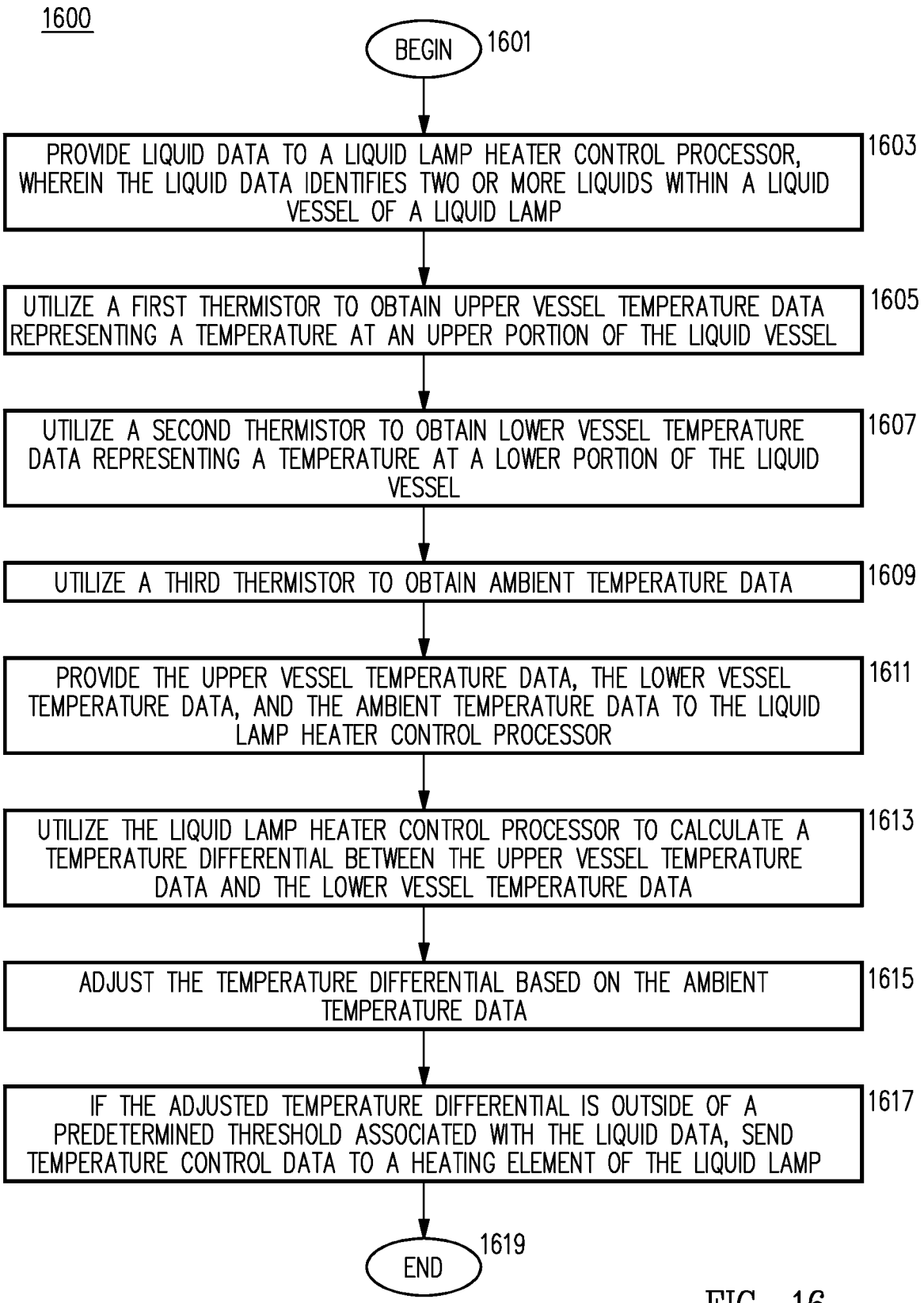
FIG. 16 is a flow chart of a heater control process utilized by a liquid lamp, in accordance with one embodiment.

FIG. 16 is a flow chart of a heater control process 1600 utilized by a liquid lamp, in accordance with one embodiment.

In one embodiment, heater control process 1600 begins at BEGIN 1601 and process flow proceeds to 1603. In one embodiment, at 1603, liquid data is provided to a liquid lamp heater control processor, wherein the liquid data identifies two or more liquids within a liquid vessel of a liquid lamp.

In one embodiment, once liquid data is provided to a liquid lamp heater control processor at 1603, process flow proceeds to 1605. In one embodiment, at 1605, a first thermistor is utilized to obtain upper vessel temperature data representing a temperature at an upper portion of the liquid vessel.

In one embodiment, once upper vessel temperature data is obtained at 1603, process flow proceeds to 1607. In one embodiment, at 1607, a second thermistor is utilized to obtain lower vessel temperature data representing a temperature at a lower portion of the liquid vessel.

In one embodiment, once lower vessel temperature data is obtained at 1607, process flow proceeds to 1609. In one embodiment, at 1609, a third thermistor is utilized to obtain ambient temperature data.

In one embodiment, once ambient temperature data is obtained at 1609, process flow proceeds to 1611. In one embodiment, at 1611, the upper vessel temperature data, the lower vessel temperature data, and the ambient temperature data are provided to the liquid lamp heater control processor.

In one embodiment once the temperature data is provided to the liquid lamp heater control processor at 1611, process flow proceeds to 1613. In one embodiment, at 1613, the liquid lamp heater control processor is utilized to calculate a temperature differential between the upper vessel temperature data and the lower vessel temperature data.

In one embodiment, once the temperature differential is calculated at 1613, process flow proceeds to 1615. In one embodiment, at 1615, the temperature differential is adjusted based on the ambient temperature data.

In one embodiment, once the temperature differential is adjusted at 1615, process flow proceeds to 1617. In one embodiment, at 1617, if the adjusted temperature differential is outside of a predetermined threshold associated with the liquid data, temperature control data is sent to a heating element of the liquid lamp.

In one embodiment, once temperature control data is sent to a heating element, process flow proceeds to END 1619, and the heater control process is exited to await new data and/or instructions.

Returning to FIG. 14A and FIG. 14B, aside from producing heat and light, in various embodiments, main logic board 317 is also fitted with a variety of other multimedia and IoT features. For example, in one embodiment, the core of main logic board 317 is multimedia wireless network engine 1111, which provides wireless network capabilities, Bluetooth® capabilities, and IoT development capabilities. In one embodiment, multimedia wireless network engine 1111 is an ESP-32 microcontroller unit. In various other embodiments, multimedia wireless network engine 1111 can be any type of device that is capable of providing wireless network, Bluetooth®, and IoT development capabilities as currently known and/or as developed after the time of filing.

In one embodiment, main logic board 317 includes logic board speakers 1405, logic board microphone 1407, logic board haptic feedback 1409, and multimedia amplifier and haptic control 1413. The logic board speakers 1405 enable the liquid lamp to play music, vocal recordings and/or other types of audio output. The logic board microphone 1407 enables the liquid lamp to respond to audio input and/or voice commands. Logic board haptic feedback 1409 enables the liquid lamp to provide vibratory feedback in response to tap touch controls.

In one embodiment, main logic board 317 contains all of the elements needed to allow the liquid lamp to function as a virtual assistant, as would be known to one of ordinary skill in the art. In one embodiment, the liquid lamp functions as a wireless network repeater. In one embodiment, one or more cameras can be mounted to the liquid lamp for a variety of purposes, such as, but not limited to, security and entertainment purposes.

In one embodiment, the elements of main logic board 317 allow an individual liquid lamp to connect wirelessly to other liquid lamps. In one embodiment, thousands of liquid lamps can be synchronized with each other. For example, one liquid lamp can be set to perform a particular sequence of lighting and/or other visual changes, and any liquid lamps that are connected together can be synchronized to perform the similar or related sequences. This feature in particular has many professional and practical uses, such as, but not limited to, use in providing light show entertainment for homes, restaurants, bars, night clubs, and concert venues.

In one embodiment, A hanging liquid lamp comprises a vessel containing two or more liquids, a clamp coupled to an upper portion of the vessel, wherein the clamp allows the vessel to be suspended from a support structure, one or more light sources, at least one heating element, wherein the at least one heating element couples to a lower portion of the vessel, two or more temperature sensors, a logic board, wherein the logic board is able to digitally control the one or more light sources and the heating element, and a bezel, wherein the bezel provides housing for the heating element and the logic board, and further wherein the bezel couples to the lower portion of the vessel.

In one embodiment, the vessel allows for at least part of the contents of the vessel to be viewed from outside of the vessel. In one embodiment, the clamp is secured around a transfer bead portion of a mouth of the vessel. In one embodiment, the heating element is a thin-film heating element. In one embodiment, the logic board includes one or more of: one or more upward facing light sources, one or more downward facing light sources, and one or more temperature sensors.

In one embodiment, the support structure is selected from the group of support structures consisting of: a support structure wherein a base of the support structure rests on a ground surface, a support structure wherein a base of the support structure rests on a furniture surface, a ceiling mounted support structure, a wall mounted support structure, a horizontal rod support structure, and a horizontal beam support structure. In embodiment, one or more power cords are secured within a cavity of the clamp such that the liquid lamp can suspended from the support structure by the one or more power cords. In one embodiment, the one or more power cords provide power to the heating element and the logic board.

In one embodiment, the hanging liquid lamp further includes a circuit board that couples to an upper portion of the vessel, wherein the one or more power cords provide power to the circuit board, and further wherein the circuit board includes one or more of: one or more light sources; and one or more temperature sensors.

In one embodiment, the bezel of the liquid lamp houses a heat insulator layer, which rests between the heating element and the logic board to protect the logic board from heat damage. In one embodiment, a lens is attached to a downward facing portion of the bezel. In one embodiment, a cap fits over the clamp, further wherein an exterior portion of the cap functions as a touch sensor to control one or more features of the liquid lamp. In one embodiment, an exterior portion of the bezel functions as a touch sensor to control one or more features of the liquid lamp. In one embodiment, the support structure can support more than one liquid lamp.

In one embodiment, one or more microcontroller units on the logic board enable wireless communication between two or more individual liquid lamps. In one embodiment, one or more microcontroller units on the logic board enable wireless communication between up to one thousand individual liquid lamps. In one embodiment, the logic board further includes one or more of: wireless network capabilities; Bluetooth® capabilities; Internet of Things (IoT) development capabilities; haptic feedback capabilities; virtual assistant capabilities; one or more speakers; one or more microphones; and one or more cameras.

In one embodiment, a system for digitally controlling a heating element of a liquid lamp comprises a liquid vessel, a logic board, a heating element, wherein the heating element is physically coupled to a bottom portion of the liquid vessel and further wherein the heating element is electrically coupled to the logic board, a first temperature sensor located at an upper portion of the liquid vessel, wherein the first temperature sensor is electrically coupled to the logic board, a second temperature sensor located at a lower portion of the liquid vessel, wherein the second temperature sensor is electrically coupled to the logic board, and a heater control component integrated into the logic board, wherein the heater control component receives temperature data from the first and second temperature sensors and utilizes the temperature data to digitally control the heat output of the heating element. In one embodiment, the system further includes a third temperature sensor located on the logic board, wherein the third temperature sensor measures ambient temperature and the heater control component utilizes the data from all three temperature sensors to digitally control the heat output of the heating element.

In one embodiment, a computing system implemented method for digitally controlling a heating element of a liquid lamp comprises providing liquid data to a liquid lamp heater control processor component of a logic board, wherein the liquid data identifies two or more liquids within a liquid vessel of a liquid lamp, utilizing a first thermistor to obtain upper vessel temperature data representing a temperature at an upper portion of the liquid vessel, utilizing a second thermistor to obtain lower vessel temperature data representing a temperature at a lower portion of the liquid vessel, utilizing a third thermistor to obtain ambient temperature data, providing the upper vessel temperature data, the lower vessel temperature data, and the ambient temperature data to the liquid lamp heater control processor, utilizing the liquid lamp heater control processor to calculate a temperature differential between the upper vessel temperature data and the lower vessel temperature data, adjusting the temperature differential based on the ambient temperature data; and if the adjusted temperature differential is outside of a predetermined threshold associated with the liquid data, sending temperature control data to a heating element of the liquid lamp.

Consequently, as discussed above, the embodiments disclosed herein provide technical solutions to the technical problems presented by current and traditional liquid lamps, which are cumbersome, bulky, energy inefficient, are not able to be driven by logic elements, and are not able to provide multimedia and/or IoT features. Further, as discussed in detail above, using the disclosed embodiments, there is considerable flexibility, adaptability, and opportunity for customization to meet the specific needs of various parties under numerous circumstances.

The present invention has been described in particular detail with respect to specific possible embodiments. Those of skill in the art will appreciate that the invention may be practiced in other embodiments. For example, the nomenclature used for components, capitalization of component designations and terms, the attributes, data structures, or any other programming or structural aspect is not significant, mandatory, or limiting, and the mechanisms that implement the invention or its features can have various different names, formats, or protocols. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the operations shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A hanging liquid lamp comprising: a vessel containing two or more liquids; a clamp secured around a transfer bead portion of a mouth of the vessel on an upper portion thereof, wherein one or more power cords are secured within a cavity of the clamp such that the vessel of the liquid lamp is capable of being suspended from a support structure by the one or more power cords; a cap, which fits over the clamp; one or more light sources including one or more upward facing light sources and one or more downward facing light sources; at least one heating element, wherein the at least one heating element couples to a lower portion of the vessel; two or more temperature sensors; a main logic board, wherein the main logic board includes one or more of the upward facing light sources and one or more of the downward facing lights sources, and further wherein the main logic board is able to digitally control the one or more light sources and the at least one heating element; a bezel coupled to the lower portion of the vessel, wherein the bezel provides housing for the at least one heating element, the main logic board and a heat insulator layer, which rests between the heating element and the main logic board to protect the main logic board from heat damage from the heating element; and a lens attached to a downward facing portion of the bezel, wherein the lens is utilized to project light downwards from the one or more of the downward facing light sources of the main logic board.

2. The hanging liquid lamp of claim 1 wherein the vessel allows for at least part of the contents of the vessel to be viewed from outside of the vessel.

3. The hanging liquid lamp of claim 1 wherein the heating element is a thin-film heating element.

4. The hanging liquid lamp of claim 1 further wherein one or more of the temperature sensors are coupled to the main logic board.

5. The hanging liquid lamp of claim 1 wherein the support structure is selected from the group of support structures consisting of:

a support structure wherein a base of the support structure rests on a ground surface;

a support structure wherein a base of the support structure rests on a furniture surface;

a ceiling mounted support structure;

a wall mounted support structure;

a horizontal rod support structure; and a horizontal beam support structure.

6. The hanging liquid lamp of claim 1 wherein the one or more power cords provide power to the heating element and the main logic board.

7. The hanging liquid lamp of claim 1 further including a secondary circuit board that couples to an upper portion of the vessel, wherein the one or more power cords provide power to the secondary circuit board, and further wherein:

one or more of the light sources is included on the secondary circuit board; and one or more of the temperature sensors is coupled to the secondary circuit board.

8. The hanging liquid lamp of claim 1 wherein an exterior portion of the cap functions as a touch sensor to control one or more features of the liquid lamp.

9. The hanging liquid lamp of claim 1 wherein an exterior portion of the bezel functions as a touch sensor to control one or more features of the liquid lamp.

10. The hanging liquid lamp of claim 1 wherein the support structure can support more than one liquid lamp.

11. The hanging liquid lamp of claim 1 wherein one or more microcontroller units on the main logic board enable wireless communication between two or more individual liquid lamps.

12. The hanging liquid lamp of claim 1 wherein one or more microcontroller units on the main logic board enable wireless communication between up to one thousand individual liquid lamps.

13. The hanging liquid lamp of claim 1 wherein the main logic board further includes one or more of:

wireless network capabilities;

wireless repeater capabilities;

haptic feedback capabilities;

virtual assistant capabilities;

one or more speakers;

one or more microphones; and one or more cameras.

* * * * *